US011767583B2

(12) United States Patent
Waeckerle et al.

(10) Patent No.: US 11,767,583 B2
(45) Date of Patent: Sep. 26, 2023

(54) FECO ALLOY, FESI ALLOY OR FE SHEET OR STRIP AND PRODUCTION METHOD THEREOF, MAGNETIC TRANSFORMER CORE PRODUCED FROM SAID SHEET OR STRIP, AND TRANSFORMER COMPRISING SAME

(71) Applicant: APERAM, Luxembourg (LU)

(72) Inventors: Thierry Waeckerle, Nevers (FR); Thierry Baudin, Gif sur Yvette (FR); Anne-Laure Helbert, Gif sur Yvette (FR); Olivier Hubert, Agnetz (FR); Rémy Batonnet, Decize (FR)

(73) Assignee: APERAM, Luxembourg (LU)

( * ) Notice: Subject to any disclaimer, the term of this patent is extended or adjusted under 35 U.S.C. 154(b) by 137 days.

(21) Appl. No.: 15/748,577

(22) PCT Filed: Jul. 29, 2016

(86) PCT No.: PCT/EP2016/068172

§ 371 (c)(1),
(2) Date: Jan. 29, 2018

(87) PCT Pub. No.: WO2017/017256

PCT Pub. Date: Feb. 2, 2017

(65) Prior Publication Data

US 2018/0223401 A1 Aug. 9, 2018

(51) Int. Cl.
*C22C 38/10* (2006.01)
*C22C 38/02* (2006.01)
(Continued)

(52) U.S. Cl.
CPC ..... *C22C 38/10* (2013.01); *C21D 1/76* (2013.01); *C21D 8/1233* (2013.01);
(Continued)

(58) Field of Classification Search
CPC ..... C22C 38/10
See application file for complete search history.

(56) References Cited

U.S. PATENT DOCUMENTS 3,977,919 A 8/1976 Foster et al.
4,416,707 A 11/1983 Foster et al.
(Continued)

FOREIGN PATENT DOCUMENTS

CN 87108230 A 7/1988
CN 1948517 A 4/2007
(Continued)

OTHER PUBLICATIONS

WO2013087939 English translation (Year: 2013).*
(Continued)

*Primary Examiner* — Sally A Merkling
*Assistant Examiner* — Sean P. O'Keefe
(74) *Attorney, Agent, or Firm* — Knobbe, Martens, Olson & Bear, LLP

(57) ABSTRACT

Sheet or strip of cold-rolled and annealed ferrous alloy (1), characterized in that its composition is, in weight percentages: traces≤Co≤40%; if Co≥35%, traces≤Si≤1.0%; if traces≤Co<35%, traces≤Si≤3.5%; if traces≤Co<35%, Si+0.6% Al≤4.5–0.1% Co; traces≤Cr<10%; traces≤V+W+Mo+Ni≤4%; traces≤Mn≤4%; traces Al≤3%; traces≤S≤0.005%; traces≤P≤0.007%; traces≤Ni≤3%; traces≤Cu≤0.5%; traces≤Nb≤0.1%; traces≤Zr≤0.1%; traces≤Ti≤0.2%; traces≤N≤0.01%; traces≤Ca≤0.01%; traces≤Mg≤0.01%; traces≤Ta≤0.01%; traces≤B≤0.005%; traces≤O≤0.01%; the remainder being iron and impurities resulting from the preparation, in that, for an induction of 1.8 T, the maximum difference (Max Δλ) between the magnetostriction deformation amplitudes λ, measured parallel to the magnetic field (Ha) applied (λ/H) and perpendicular to the magnetic field
(Continued)

(Ha) applied ($\lambda^{\perp}$H) on three rectangular samples (2, 3, 4) of the said sheet or strip whose long sides are respectively parallel to the direction of rolling (DL) of the said sheet or strip, parallel to the transverse direction (DT) of the said sheet or strip, and parallel to the direction forming an angle of 45° with the said rolling direction (DL) and the said transverse direction (DT), being at most 25 ppm, and in that its recrystallization rate is 80 to 100%.

Method of manufacturing such a sheet or strip, transformer magnetic core made from it and a transformer comprising it.

12 Claims, 6 Drawing Sheets

(51) Int. Cl.

| | |
|---|---|
| ***C22C 38/06*** | (2006.01) |
| ***H01F 1/18*** | (2006.01) |
| ***H01F 41/02*** | (2006.01) |
| ***C22C 38/18*** | (2006.01) |
| ***H01F 1/147*** | (2006.01) |
| ***C22C 38/30*** | (2006.01) |
| ***C22C 38/52*** | (2006.01) |
| ***C21D 8/12*** | (2006.01) |
| ***C21D 1/76*** | (2006.01) |

(52) U.S. Cl.
CPC ..... *C21D 8/1266* (2013.01); *C21D 8/1272* (2013.01); *C22C 38/02* (2013.01); *C22C 38/06* (2013.01); *C22C 38/18* (2013.01); *H01F 1/147* (2013.01); *H01F 1/14783* (2013.01); *H01F 1/18* (2013.01); *H01F 41/0233* (2013.01); *C21D 8/1222* (2013.01); *C21D 2211/005* (2013.01); *C22C 38/30* (2013.01); *C22C 38/52* (2013.01)

(56) References Cited

U.S. PATENT DOCUMENTS

| | | | | |
|---|---|---|---|---|
| 4,896,544 | A | 1/1990 | Garshelis | |
| 2007/0126546 | A1* | 6/2007 | Guenther | C22C 38/002 336/229 |
| 2013/0000797 | A1* | 1/2013 | Pieper | C21D 8/1222 148/557 |
| 2014/0299233 | A1 | 10/2014 | Waeckerle et al. | |
| 2015/0206632 | A1* | 7/2015 | Fohr | C22C 38/002 420/83 |

FOREIGN PATENT DOCUMENTS

| | | | | |
|---|---|---|---|---|
| CN | 101713047 | A | 5/2010 | |
| CN | 104114724 | A | 10/2014 | |
| EP | 0981822 | A1 | 3/2000 | |
| EP | 1108794 | A1 | 6/2001 | |
| EP | 1176221 | A2 | 1/2002 | |
| EP | 3162907 | A1 | 5/2017 | |
| GB | 1426109 | A | 2/1976 | |
| JP | 48097726 | A | 12/1973 | |
| JP | H01-119642 | A | 5/1989 | |
| JP | 08203718 | A | 8/1996 | |
| JP | H08203718 | A | 8/1996 | |
| JP | 2001-119642 | A | 4/2001 | |
| JP | 2001/164344 | A | 6/2001 | |
| JP | 2001/181803 | A | 7/2001 | |
| JP | 2001/247944 | A | 9/2001 | |
| JP | 2001247944 | A * | 9/2001 | |
| JP | 2003/213335 | A | 7/2003 | |
| JP | 2005060811 | A | 3/2005 | |
| JP | 2006/274405 | A | 10/2006 | |
| JP | 2011-084761 | A | 4/2011 | |
| JP | 2012/241210 | A | 12/2012 | |
| JP | 2015/061941 | A | 4/2015 | |
| KR | 10-2014-0108559 | A | 9/2014 | |
| KR | 10-2018-0035833 | A | 4/2018 | |
| WO | 1998052200 | | 11/1998 | |
| WO | 2013/087939 | A1 | 6/2013 | |
| WO | WO-2013087939 | A1 * | 6/2013 | C21D 8/1261 |
| WO | 2015/199211 | A1 | 12/2015 | |

OTHER PUBLICATIONS

JP-2001247944-A English language translation (Year: 2001).*
International Search Report for PCT/EP2015/067443 dated Apr. 29, 2016 in 3 pages.
International Search Report for PCT/EP2016/068172 dated Oct. 20, 2016 in 6 pages.
Somkun et al., "Magnetostriction Anisotropy and Rotational Magnetostriction of a Nonoriented Electrical Steel"; IEEE Transactions on Magnetics, vol. 46, No. 2, Feb. 2010.
Powercore A grades, "Electrical steel (NO)—Standard grades fully finished", dated Oct. 30, 2020 in 1 page.

* cited by examiner

FECO ALLOY, FESI ALLOY OR FE SHEET OR STRIP AND PRODUCTION METHOD THEREOF, MAGNETIC TRANSFORMER CORE PRODUCED FROM SAID SHEET OR STRIP, AND TRANSFORMER COMPRISING SAME

CROSS-REFERENCE TO RELATED APPLICATIONS

This application is the U.S. National Phase under 35 U.S.C. § 371 of International Application PCT/EP2016/068172, filed Jul. 29, 2016, which claims priority to PCT/EP2015/067443 filed Jul. 29, 2015. The disclosures of the above-described applications are hereby incorporated by reference in their entirety.

FIELD OF THE INVENTION

The present invention relates to alloys of iron and cobalt, particularly those having a content of the order of 10 to 35% of Co, and also pure iron and alloys of iron and silicon which have a content of 3% of Si. These materials are used to form magnetic parts such as transformer cores, especially for aircraft.

SUMMARY OF THE INVENTION

Low-frequency transformers (≤1 kHz) on-board an aircraft consist mainly of a soft magnet magnetic core laminated, stacked or wound according to construction constraints, and primary and secondary windings (copper). The primary supply currents are variable over time, periodic but not necessarily purely sinusoidal, which does not fundamentally change the needs of the transformer.

The constraints on these transformers are multiple.

They must have a volume and/or a mass (generally the two are closely connected) that is as small as possible, so that the volumetric or mass power density is as high as possible. The lower the operating frequency, the greater has to be the section of the magnetic yoke and the volume (thus also the mass) of this yoke, which exacerbates the interest of miniaturizing it for low frequency applications. Since the fundamental frequency is very often mandatory, this amounts to obtaining the highest possible magnetic working flux or, if the electric power supplied is mandatory, to reduce as far as possible the passage section of the magnetic flux (and therefore the mass of the materials), in order to further increase the mass power by reducing the on-board masses.

They must have sufficient longevity (at least 10 to 20 years depending on the application) to make them profitable. Therefore, the thermal operating regime must be taken into account with respect to the aging of the transformer. Typically a minimum life of 100,000 h at 200° C. is desired.

The transformer has to operate on a largely sinusoidal frequency power supply network, with an amplitude of the output rms voltage that may vary transiently by up to 60% from one moment to the next, and, in particular, when the transformer is energized or when an electromagnetic actuator is suddenly switched on. This has the consequence, and by construction, of a current inrush to the primary of the transformer through the nonlinear magnetization curve of the magnetic core. The elements of the transformer (insulators and electronic components) must be able to withstand, without damage, large variations of this inrush current, the so-called "inrush effect".

This inrush effect may be quantified by an "inrush index" (In) which is calculated with the formula In=2.Bt+Br−Bsat, where Bt is the nominal working induction of the magnetic core of the transformer, Bsat is the saturation induction of the core, while Br is its residual induction.

The noise emitted by the transformer due to electromagnetic forces and magnetostriction must be low enough to comply with the standards in force or to meet the requirements of users and personnel posted near the transformer. Increasingly, pilots and co-pilots wish to be able to communicate directly but without the need for headphones.

The thermal efficiency of the transformer is also very important, since it determines both its internal operating temperature and the heat flows that must be removed, for example by means of an oil bath surrounding the windings and the yoke, and which is associated with oil pumps dimensioned accordingly. The thermal power sources are mainly in the form of Joule losses from primary and secondary windings, and magnetic losses from changes in magnetic flux over time and in the magnetic material. In industrial practice, the volume thermal power to be extracted is limited to a certain threshold imposed by the size and power of the oil pumps, and the internal operating limit temperature of the transformer.

Finally, the cost of the transformer must be kept as low as possible to ensure the best technico-economic compromise between cost of materials, design, manufacturing and maintenance, and optimization of the electrical power density (mass or volume) of the device by taking into account the thermal regime of the transformer.

In general, it is advantageous to look for the highest mass/volume power density possible. The criteria to be considered are mainly saturation magnetization Js and magnetic induction at 800 A/m $B_{800}$.

Two technologies for manufacturing on-board low-frequency transformers are currently used.

According to a first of these techniques (called "rolled-up core"), the transformer comprises a wound magnetic circuit when the power supply is single-phase. When the power supply is three-phase, the structure of the core of the transformer comprises two toroidal cores of the preceding contiguous type, and surrounded by a third wound toroid forming an "eight" around the two previous toroidal cores. In practice, this form of circuit requires a small thickness of the magnetic sheet (typically 0.1 mm). In fact, this technology is used only when the supply frequency requires, taking into account the induced currents, the use of strips of this thickness, i.e. typically for frequencies of a few hundred Hz.

According to the second of these techniques (called "stamp and stack core"), a stacked magnetic circuit is used, whatever the thicknesses of magnetic sheets. This technology is therefore valid for any frequency below a few kHz. However, particular care must be taken in the deburring, juxtaposing, even the electrical insulation of the sheets, in order to reduce both the parasitic air gaps (and thus optimize the apparent power) and to limit the currents induced between the sheets.

In either of these technologies, a soft magnetic material with high permeability is used in the on-board power transformers whatever the strip thickness envisaged. Two families of these materials exist in thicknesses of 0.35 mm to 0.1 mm or even 0.05 mm, and are clearly distinguished by their chemical compositions:

Fe-3% Si alloys (the compositions of the alloys are given throughout the text in % by weight) whose brittleness and electrical resistivity are mainly controlled by the Si content; wherein their magnetic losses are quite low (N.O. non-oriented grain alloys) to low (O.G. oriented grain alloys), their saturation magnetization Js is high (of the order of 2 T), while their cost is very moderate; There are two Fe-3% Si subfamilies used for one or the other on-board transformer core technology:

Fe-3% Si with oriented grains (O.G.), used for on-board transformer structures of the "rolled-up" type: wherein their high permeability ($B_{800}$=1.8 –1.9 T) is related to their very pronounced {110}<001> texture; these alloys have the advantage of being inexpensive, easy to form, and of high permeability, but their saturation is limited to 2 T, and they have a very marked non-linearity of the magnetization curve which may cause very significant harmonics;

(N.O.) Non-oriented grain Fe-3% Si used for "stamp and stack" type on-board transformer structures; wherein their permeability is reduced, while their saturation magnetization is similar to that of the O.G.;

Fe-48% Co-2% V alloys, whose brittleness and electrical resistivity are mainly controlled by vanadium; they owe their high magnetic permeabilities not only to their physical characteristics (weak K1) but also to the cooling after final annealing which sets K1 at a very low value; however, because of their fragility, these alloys must be shaped in the hardened state (by cutting, stamping, folding . . . ), and the material is then annealed in the last step only once the piece has received its final shape (rotor or stator of rotating machine, E or I profile of the transformer); moreover, because of the presence of V, the quality of the annealing atmosphere must be perfectly controlled to avoid oxidizing; finally the price of this material, very high (20 to 50 times that of Fe-3% Si-O.G.), is related to the presence of Co and is roughly proportional to the content of Co; however, Fe—Co alloys with lower levels of Co (typically 18 or 27%) also exist and have the advantage of being cheaper than the previous ones, as they contain less Co, while providing saturation magnetization that is as good, or in some cases even a little higher, than that of the previous FeCo48V2 alloy; however, their magnetic permeability and magnetic losses are significantly higher than those of FeCo equiatomic alloys.

Only these two families of high permeability materials are currently used in on-board power transformers.

Except for the FeCo equiatomic alloy, the high saturation materials (pure Fe, Fe—Si or Fe—Co at less than 40% Co) have a magnetocrystalline anisotropy of several tens of kJ/m$^3$, which does not allow them to have a high permeability in the event of a random distribution of the final crystallographic orientations. In the case of magnetic plates with less than 48% Co for medium-frequency on-board transformers, it has long been known that the chances of success necessarily depend on an acute texture characterized by the fact that in each grain, a <100> axis is very close to the rolling direction. The {110}<001> so-called "Goss" texture obtained in Fe—Si by secondary recrystallization is a case in point. However, according to these reference works the sheet should not contain cobalt.

More recently, it has been shown in U.S. Pat. No. 3,881,967 that high permeabilities may also be obtained with additions of 4 to 6% Co and 1 to 1.5% Si, and also by using secondary recrystallization: $B_{800}$≈1.98 T, i.e. a gain of 0.02 T/% Co at 800 A/m compared to the best current Fe 3% Si O.G. sheets ($B_{10}$≈1.90 T). However, it is clear that an increase of only 4% of the $B_{800}$ is not enough to significantly lighten a transformer. By way of comparison, an Fe-48% Co-2% V alloy optimized for transforming has a $B_{800}$ of approximately 2.15 T±0.05 T, which allows an increase in magnetic flux at 800 A/m for the same yoke section of 13%±3%, of about 15% at 2500 A/m, and about 16% at 5000 A/m.

The presence of coarse grains in the Fe 3% Si-O.G. due to secondary recrystallization should also be noted, as well as a very small disorientation between crystals allowing a $B_{800}$ of 1.9 T, coupled with the presence of a magnetostriction coefficient $\lambda_{100}$, that is very clearly greater than 0. This makes this material very sensitive to mounting and operating constraints, which brings the $B_{800}$ of an Fe 3% Si O.G. back into industrial practice by operating in an on-board transformer at about 1.8 T. This is also the case for the alloys of U.S. Pat. No. 3,881,967. Furthermore, Fe-48% Co-2% V has magnetostriction coefficients of amplitude even 4 to 5 times higher than the Fe-3% Si, a random distribution of the crystallographic orientations, and a small average grain size (a few tens of microns), which makes it very sensitive to weak constraints in particular those which cause very strong variations of the magnetization characteristic J(H), and thus also of B(H). These variations tend to improvement when the constraint is unidirectional and in traction, while they tend to degradation when the constraint is unidirectional and in compression.

In operation, due to the increase in magnetization and saturation induction, it must be taken into account that the replacement of an Fe 3% Si O.G. by an Fe-48% Co-2% V brings an increase in the constant section magnetic flux of the on-board transformer of the order of 20 to 25% for operating field amplitudes of 800 to 5000 A/m, i.e. an approximately 0.5% increase in magnetic flux per % Co. The alloy of U.S. Pat. No. 3,881,967 permits a 1% increase in magnetic flux per 1% Co, but as stated, this total increase (4%) is considered too weak to justify the development of this material.

It has also been proposed, in particular in document U.S. Pat. No. 3,843,424, to use a Fe-5-35% Co alloy having less than 2% Cr and less than 3% Si and having a Goss texture obtained by primary recrystallization and normal grain growth. Compositions of Fe-27% Co-0.6% Cr or Fe-18% Co-0.6% Cr are cited as making it possible to attain 2.08 T at 800 A/m and 2.3 T at 8000 A/m. In operation and compared to an Fe-3% Si-O.G. sheet operating at 1.8 Tat 800 A/m, and at 1.95 T at 5000 A/m, these values would allow an increase in the magnetic flux in a given yoke section of 15% at 800 A/m and 18% at 5000 A/m, and therefore would reduce the volume or mass of the transformer accordingly. Thus, several compositions and processes for the manufacture of Fe-low Co alloys (with possible additions of alloying elements) have been proposed, generally making it possible to obtain magnetic inductions at 10 Oe-close to those accessible with Fe-48% Co-2% V commercial alloys but with Co levels (and thus cost) that are significantly lower (18 to 25%).

However, experience shows that all these materials, when obtained and processed by the usual processes, exhibit high magnetostrictions, at least with respect to some of their directions (taking, for example, the rolling direction DL as a reference). Since the direction of the magnetic excitation may vary greatly from one place to another of the magnetic circuit while at the same time, this lack of homogeneity of the magnetostriction according to the different directions may very well lead to the generation of a very significant magnetostriction noise, even if the magnetostriction in one determined direction proves to be weak.

It is not known for Fe—Ni alloys to be used in aircraft transformers using stamp and stack core technology. In fact, these materials have a saturation magnetization Js (1.6 T maximum for Fe—Ni50 much lower than Fe—Si (2 T) or Fe—Co (>2.3 T) cited above and, moreover, they have magnetostriction coefficients for FeNi50 of $\lambda_{111}$=7 ppm and $\lambda_{100}$=27 ppm. This results in an apparent saturation magnetostriction $\lambda_{sat}$=27 ppm for a Fe—Ni50 polycrystalline material of the "non-oriented" type (i.e. having no pronounced texture). Such a level of magnetostriction generates a high noise, and this, added to a quite moderate saturation magnetization Js, explains why this material is not used.

In summary, various issues facing aircraft transformer designers may also arise.

In the absence of a strong requirement with respect to noise due to magnetostriction, the compromise between the requirements with respect to a low inrush effect, a high mass density of the transformer, high efficiency and low magnetic losses, leads to the use of wound magnetic cores solutions using Fe—Si O.G., Fe—Co, or in iron-based amorphous materials, or solutions involving stamp and stack magnetic cores using Fe—Si N.O. or Fe—Co.

In the latter case, E-shaped or I-shaped stamped and stacked cores in FeSi N.O. or O.G. electric steel or in FeCo alloys such as Fe49Co49V2 are frequently used. But since these materials have a significant magnetostriction and the magnetization direction does not always remain in the same crystallographic direction in an E structure, these transformer structures may deform a great deal and emit a significant noise if their dimensioning is effected with a usual working induction level (about 70% of Js). To reduce the emission of noise, it is necessary to:

- either reduce the working induction, but while increasing the core section in the same ratio, and thus its volume and mass in order to maintain the same power transferred;
- or, to acoustically shield the transformer, resulting in additional cost and an increase in the mass and volume of the transformer.

Under these conditions, it is far from always possible to design a transformer that simultaneously meets the weight and noise constraints of the specifications.

As the requirements with respect to low noise magnetostriction become increasingly widespread, it is not possible to satisfy them using previous technologies other than by increasing the volume and mass of the transformer, because it is not known how to reduce the noise, other than by reducing the average working induction Bt, thus increasing the core section and total mass in order to maintain the same magnetic flux. B1 must be lowered to about 1 T instead of 1.4 to 1.7 T for Fe—Si or Fe—Co in the absence of noise requirements. It is also necessary, often, to pad the transformer, resulting in an increase in weight and bulk.

Only a material with zero magnetostriction could, at first glance, solve the problem, provided that it has a higher working induction than current solutions. Only the Fe-80% Ni alloys which have a saturation induction Js of about 0.75 T, and the nanocrystallines of the said Js is about 1.26 T, have such a low magnetostriction. But Fe-80% Ni alloys have a Bt working induction that is too low to provide lighter transformers than traditional transformers. Only nanocrystallines allow this lightening where a very low noise is required. When the need for noise reduction is less significant, nanocrystallines appear to be a relatively silent solution, but require too much weighting compared to the solution of lowering the working induction in traditional solutions, and/or padding the transformer.

But the nanocrystallines pose a major problem in the case of an "on-board transformer" solution: their thickness is about 20 μm and they are wound in toroids in an amorphous soft state around a rigid support, in order to ensure that the shape of the toroid is retained throughout the heat treatment resulting in nanocrystallization. And this support may not be removed after the heat treatment in order to permanently preserve the shape of the toroid, and also because the toroid is then often cut in half to offer improved compactness of the transformer by using the technology of the rolled-up circuit previously described. Only by impregnating resins into the rolled-up core may maintain it in the same shape in the absence of the support that is removed after polymerization of the resin. But after a C-cut of the nanocrystalline impregnated and hardened toroid, there may be a deformation of the C which prevents the two parts from being positioned exactly face to face in order to reconstruct the closed toroid once the windings have been inserted. The constraints of fixing the Cs within the transformer may also lead to its deformation. It is therefore preferable to keep the support, but which, however, increases the weight of the transformer. In addition, the nanocrystallines have a saturation magnetization Js that is clearly lower than other soft materials (iron, FeSi3%, Fe—Ni50%, FeCo, amorphous iron base alloy), which leads to a significant increase in the weight of the transformer, since the increase in the magnetic core section has to compensate for the drop in working induction imposed by Js. In addition, the "nanocrystalline" solution would only be used as a last resort if the maximum noise level required is low, and if another lighter and less noisy solution is not available.

The object of the invention is to propose a material for constituting transformer cores presenting only very low magnetostriction, even when they are subjected to a strong working induction, which would thus make it possible not to use too great a mass of magnetic core, and therefore to provide transformers having a high mass (or volume) density. Transformers obtained in this way may be advantageously used in environments such as an aircraft cockpit where low magnetostriction noise is advantageous for the comfort of users.

To this end, the subject of the invention is a sheet or strip of cold-rolled and annealed ferrous alloy, characterized in that its composition consists of, in weight percentages:

- traces≤C≤0.2%, preferably traces≤C≤0.05%, more preferably traces≤C≤0.015%;
- traces≤Co≤40%;
- if Co≥35%, traces≤Si≤1.0%;
- if traces≤Co<35%, traces≤Si≤3.5%;
- if traces≤Co<35%, Si+0.6·Al(wt %)≤4.5(wt %)−0.1% Co, preferably Si(wt %)+0.6·Al(wt %)≤3.5(wt %)−0.1·Co(wt %);
- traces≤Cr≤10%;
- traces≤V+W+Mo+Ni≤4%, preferably≤2%;
- traces≤Mn≤4%, preferably≤2%;
- traces≤Al≤3%, preferably≤1%;
- traces≤S≤0.005%;
- traces≤P≤0.007%;
- traces≤Ni≤3%, preferably≤0.3%;
- traces≤Cu≤0.5%, preferably≤0.05%;
- traces≤Nb≤0.1%, preferably≤0.01%;
- traces≤Zr≤0.1%, preferably≤0.01%;
- traces≤Ti≤0.2%;
- traces≤N≤0.01%;
- traces≤Ca≤0.01%;
- traces≤Mg≤0.01%;
- traces≤Ta≤0.01%;

traces≤B≤0.005%;

traces≤O≤0.01%;

the remainder being iron and impurities resulting from the preparation, in that, for an induction of 1.8 T, the maximum difference (Max Δλ) between the magnetostriction deformation amplitudes λ, measured parallel to the magnetic field (Ha) applied (λ/H) and perpendicular to the magnetic field (Ha) applied ($\lambda^{\perp}$H) on three rectangular samples (2, 3, 4) of the said sheet or strip whose long sides are respectively parallel to the rolling direction (DL) of the said sheet or strip, parallel to the transverse direction (DT) of the said sheet or strip, and parallel to the direction forming an angle of 45° with the said rolling direction (DL) and with the said transverse direction (DT), is at most 25 ppm, and in that its recrystallization rate is 80 to 100%.

According to a variant of the invention, 10%≤Co≤35%.

Preferably, the strip or sheet has no more than 30% of any {hk1}<uvw> texture component defined by a disorientation of less than 15° from a defined crystallographic orientation $\{h_0k_0l_0\}<u_0v_0w_0>$.

The invention also relates to a method for manufacturing a ferrous alloy strip or sheet of the above type, characterized in that:

a ferrous alloy is prepared, the composition of which consists of:

traces≤C≤0.2%, preferably traces≤C≤0.05%, more preferably traces≤C≤0.015%;

traces≤Co≤40%;

if Co≥35%, traces≤Si≤1.0%;

if traces≤Co<35%, traces≤Si≤3.5%;

if traces≤Co<35%, Si(wt %)+0.6·Al(wt %)≤4.5(wt %)−0.1·Co(wt %), preferably Si(wt %)+0.6·Al(wt %)≤3.5(wt %)−0.1·Co(wt %);

traces≤Cr≤10%;

traces≤V+W+Mo+Ni≤4%, preferably≤2%;

traces≤Mn≤4%, preferably≤2%;

traces≤Al≤3%, preferably≤1%;

traces≤S≤0.005%;

traces≤P≤0.007%;

traces≤Ni≤3%, preferably≤0.3%;

traces≤Cu≤0.5%, preferably≤0.05%;

traces≤Nb or Zr≤0.1%, preferably<0.01% traces≤Ni≤3%, preferably≤0.3%;

traces≤Cu≤0.5%, preferably≤0.05%;

traces≤Nb≤0.1%, preferably≤0.01%;

traces≤Zr≤0.1%, preferably≤0.01%;

traces≤Ti≤0.2%;

traces≤N≤0.01%;

traces≤Ca≤0.01%;

traces≤Mg≤0.01%;

traces≤Ta≤0.01%;

traces B 0.005%;

traces≤O≤0.01%;

the remainder being iron and impurities resulting from the preparation;

it is cast in the form of an ingot or a semi-finished continuously cast product;

wherein the said ingot or semi-finished continuously cast product is hot-shaped in the form of a strip or a sheet 2 to 5 mm thick, preferably 2 to 3.5 mm thick;

followed by at least two cold rolling operations of the said strip or sheet, each having a reduction ratio of 50 to 80%, preferably 60 to 75%, at a temperature which is:

from ambient temperature to 350° C. if the alloy has such an Si content that 3.5(wt %)−0.1·Al(wt %)≤Si(wt %)+0.6·Al(wt %)≤4.5(wt %)−0.1·Co(wt %) and Co<35%, or if the alloy contains Co≥35% and Si≤1%;

and if the cold rolling is preceded by reheating, preferably stoving, for a period of 1 h to 10 h and at a maximum temperature of 400° C.;

from ambient temperature to 100° C. in other cases;

wherein the said cold rollings are each separated by static or continuous annealing in the ferritic range of the alloy, for 1 minute to 24 hours, preferably for 2 minutes to 1 hour, at a temperature of at least 650° C., preferably at least 750° C., and, at most:

1400° C. if the Si content of the alloy is greater than or equal to $(\%\ Si)_{\alpha\text{-}lim}$=1.92(wt %)+0.07·Co(wt %)+58 C (wt %);

$T_{\alpha\text{-}lim}=T_0+k$ Si(wt %), where $T_0$=900+2·Co(wt %)−2833·C(wt %) and k=112−1250·C(wt %), if the Si content is less than $(\%\ Si)_{\alpha\text{-}lim}$;

wherein the said annealing separating two cold rolling operations takes place in an atmosphere containing at least 5% of hydrogen, preferably 100% of hydrogen, and less than 1% in total of gaseous oxidizing species for the alloy, preferably less than 100 ppm, and having a dew point below +20° C., preferably below 0° C., more preferably below -40° C., optimally below −60° C.;

and wherein a final static or continuous recrystallization annealing is carried out in the ferritic range of the alloy for 1 min to 48 h, at a temperature of 650 to (900±2% Co)° C., in order to obtain a recrystallization rate of the strip or the sheet of from 80 to 100%.

The final recrystallization annealing may be carried out under vacuum, or in a non-oxidizing atmosphere for the alloy, or in a hydrogenated atmosphere.

The final recrystallization annealing may be carried out in an atmosphere containing at least 5% hydrogen, preferably 100% hydrogen, and less than 1% in total of gaseous oxidizing species for the alloy, preferably less than 100 ppm, and having a dew point below +20° C., preferably below 0° C., more preferably below −40° C., optimally below −60° C.

The first cold rolling may be preceded by static or continuous annealing in the ferritic range of the alloy for 1 min to 24 hours, preferably for 2 min to 10 hours, at a temperature of at least 650° C., preferably at least 700° C., and, at most:

1400° C. if the Si content of the alloy is greater than or equal to $(\%\ Si)_{\alpha\text{-}lim}$=1.92(wt %)+0.07·Co(wt %)+58·C (wt %);

$T_{\alpha\text{-}lim}=T_0+k$ Si(wt %), where $T_0$=900+2·Co(wt %)−2833·C(wt %) and k=112−1250·C(wt %), if the Si content is less than $(\%\ Si)_{\alpha\text{-}lim}$;

wherein the said annealing takes place in an atmosphere containing at least 5% hydrogen, preferably 100% hydrogen, and less than 1% in total of gaseous oxidizing species for the alloy, preferably less than 100 ppm, and having a dew point below +20° C., preferably below 0° C., more preferably below −40° C., optimally below −60° C.

The final recrystallization annealing may be followed by cooling carried out at a speed of less than or equal to 2000° C./h, preferably less than or equal to 600° C./h.

The final recrystallization annealing may be preceded by heating performed at a speed less than or equal to 2000° C./h, preferably less than or equal to 600° C./h.

After the final recrystallization annealing, it is possible to carry out oxidation annealing at a temperature between 400 and 700° C., preferably between 400 and 550° C., for a period of time sufficient to obtain an insulating oxidized layer with a thickness of 1 to 10 μm on the surface of the sheet or strip.

The invention also relates to a transformer magnetic core, characterized in that it is composed of stacked or rolled-up sheets, at least some of which are manufactured from a sheet or strip of the preceding type.

The subject of the invention is a transformer comprising a magnetic core, characterized in that the said core is of the preceding type.

As will have been understood, the invention is based on the use of a material that is intended to constitute magnetic parts, such as elements of a transformer core, in the form of an iron-cobalt or iron-silicon or iron-silicon-aluminum alloy, and on which well-defined thermal and mechanical treatments have been carried out, wherein the heat treatments are all in the ferritic range of the alloy. The use of pure, or very slightly alloyed iron, is also envisaged.

Quite unexpectedly, and in a manner that the inventors are not in a position, for the moment, to explain in a well-founded manner, the result is a magnetostriction which, in the first place, is very low even in magnetic fields of high intensity that may reach, for example, up to 1.5 or 1.8 T. This result is surprising, particularly in the case of the FeCo type materials affected by the invention, because FeCo alloys have been known for a long time to usually have high apparent magnetostriction.

But above all, what was particularly unexpected, was that this magnetostriction presents a remarkable isotropy, even for these high fields. It remains, in fact, almost zero both in the rolling direction and in the transverse direction (perpendicular to the rolling direction), and in a direction forming an angle of 45° with these two directions, and up to an ambient magnetic field of at least 1 T. Beyond 1 T, the difference between the magnetostrictions observed in these three directions remains remarkably reduced down to a field of at least 1.8 T, or even 2 T.

Thus, one obtains transformers having low magnetostrictive noise in all directions of the sheets constituting their cores, and therefore a particularly low overall magnetostriction noise, making them suitable for constituting, in particular, on-board transformers for aircraft that may be placed in the cockpit without hindering direct conversations between occupants.

BRIEF DESCRIPTION OF THE DRAWINGS

The invention will be better understood with the aid of the description which follows, given with reference to the following appended figures.

DETAILED DESCRIPTION OF THE PREFERRED EMBODIMENTS

Figure 1:
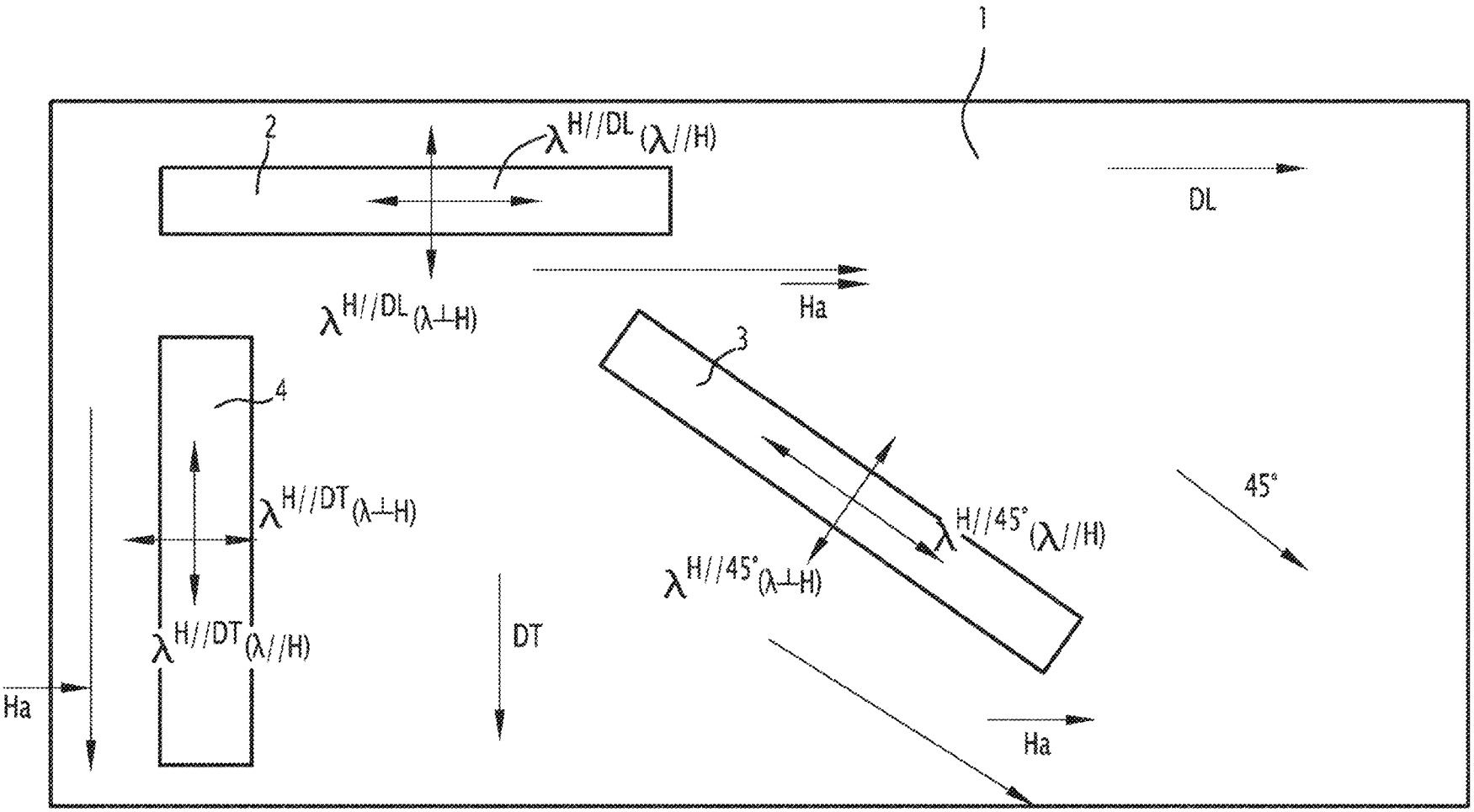
FIG. 1 shows how the sheet samples that were used in tests according to the invention and reference tests were sampled and tested.

The metals and alloys to which the invention applies are iron and ferrous alloys with a ferritic structure, containing, in addition to iron and impurities and residual elements resulting from their preparation, the following chemical elements. All percentages are percentages by weight.

When one speaks of "traces" to define the lower limit of a range of contents of a given element, it should be understood, as is usual for metallurgists, to mean that the element in question is present at most at a very low level, without influence on the properties of the material, but of which it may not be affirmed with certainty that it would always be rigorously zero. Generally, a small amount of the element in question is detected in the final alloy by the analysis apparatus, because of its almost inevitable presence in some of the raw materials used, or because of the pollution introduced during the preparation of the liquid metal. This pollution may be due, for example, to wear of the refractory materials, in particular containing magnesia and/or alumina and/or silica, which coat the containers (melting furnace, ladle, etc.) and in which the liquid metal is found. The contact of the liquid metal with the atmosphere may also lead to the absorption of nitrogen, and also oxygen which may be combined with the most deoxidizing elements (Al, Si, Mn, Ti, Zr . . . ) to form non-metallic inclusions, some of which will remain in the final metal. The accuracy of the analysis apparatus for the detection and measurement of the content of the element in question also needs to be taken into account. In general, it is considered that when an element is said to be able to be present in the form of a "trace", this includes all the cases where its content is merely uncontrolled, i.e. the element was not intentionally added during preparation, and that it is not necessary to maintain this content above a specific limit. In particular, if an element is not explicitly mentioned in the definition of the alloy used in the invention, it must be considered that its possible presence is limited to "traces" as just defined.

For elements that are said to be present at a content between a "traces" level and a defined upper limit, this means that the limit is:

- either an upper limit of the impurity level not to be exceeded, since beyond this limit, certain properties of the alloy would be insufficient, and it must then be ensured that the said impurities do not exceed this limit by carefully selecting the raw materials and/or avoiding as far as possible, the pollution of the liquid metal during preparation, and/or by carrying out operations specifically intended to lower the content of the impurity during the preparation when this is necessary and possible (desulfurization, dephosphorization . . . );
- or an upper limit which corresponds to that of an intentional addition of the element in question in order to confer advantageous properties on the final alloy, wherein this addition is therefore optional.

In the tables showing the composition of the various alloys tested, it should be understood that when a content is noted as being "less than . . . ", this amounts to saying that the element in question is present only in the form of traces in the sense given above, wherein the analytical apparatus is not able to determine very reliably whether the element is really totally absent, or whether it is present but at a lower level than the low limit given in the table.

The alloys composing the sheets or strips according to the invention contain C at a content between traces resulting from the preparation without C having been added to the raw materials, and 0.2%, preferably between traces and 0.05%, more preferably between traces and 0.015%.

FeCo27 and FeSi3 type alloys under which certain possible variants of the invention fall, typically have C contents of 0.005 to 0.15%, which result much more from the deoxidation conditions of the liquid metal (in particular the formation of CO within the liquid metal during steps performed under vacuum) than a deliberate intention to have these C contents in the final product for reasons related to the mechanical or magnetic properties of the alloy.

In fact, it is not desirable to find a very significant C content in the final alloy used in the invention, since beyond a threshold which may be between 0.05 and 0.2%, it is possible to observe a precipitation of carbides which tend to degrade the magnetic properties, while content of more than 0.2% is unacceptable in all cases for this reason. In addition, it is known that above 0.01% of C, it is possible to observe aging precipitation of masses or clusters of C, after the transformer has been operating for months or years above ambient temperature. Magnetic properties (magnetic losses, permeability . . . ) may be affected. For these reasons, it is preferable to maintain the C content within the optimum limits mentioned above.

They contain between traces and 40% of Co. The maximum of 40% is determined by the desire not to have a transition order-disorder too fast and acute during thermal treatments. This would prevent multiple annealings after hot rolling, and it will be seen that two annealings, preferably three, preceding or following cold rolling are necessary for the implementation of the invention. Performing more cold rollings with corresponding intermediate annealings is also possible when it is desired to obtain particularly fine strips used in a rolled-up core transformer.

The Co may be present in limited quantity, only in the state of traces resulting from the preparation, i.e. not when added intentionally, but if Co<35% it is necessary for Si(wt %)+0.6·Al(wt %)≤4.5(wt %)−0.1·Co(wt%) and also Si≤3.5%. Thus, for example, in the absence of cobalt, a traces content of 3.5% of Si and traces to 1% Al are required in order to remain within the scope of the invention. It is then a case of an alloy being in the class of iron-silicon or iron-silicon-aluminum alloys, or even a pure, or very slightly alloyed, iron, to which the invention may also be applied.

In the case of a genuine iron-cobalt alloy (which would therefore contain less than 3.5% Si), a Co content of 10 to 35% is preferred.

The invention most typically applies to Fe—Co alloys of a conventional type containing about 27% Co and to Fe—Si alloys with about 3% Si.

The alloy to which the invention applies has a Si content as follows:

traces to 1.0% if the Co content is at least 35%;

if the Co content is less than 35%: Si(wt %)+0.6%·Al(wt %)≤3.5−0.1·Co(wt %).

However, a content of Si+0.6·Al(wt %)≤4.5(wt %)−0.1·Co(wt %) may be accepted if the rolling is carried out when not strictly cold, but "warm", i.e. at a temperature up to 350° C., wherein this rolling temperature is preferably obtained by stoving, i.e. heating in a static chamber at a low temperature. This warm rolling (wherein it is accepted that this is fully comparable to cold rolling in the context of the invention, and the term "cold rolling", when there are no more details on the temperature of its operation, should be understood in the present text to include also warm rolling up to 350° C. This is opposed to hot-rolling known to metallurgists, which is carried out at significantly higher temperatures of several hundred degrees, or even 1000° C. or more), compared to rolling performed at, or near, ambient temperature, allows the material to be rolled better, is more ductile and less likely to crack during rolling. Static heating in an oven of the hot-rolled strip and the hot-rolled sheet allows the winding or sheet to be kept at the desired temperature for a few hours, so that the temperature becomes uniform throughout the material before the warm rolling is carried out. An annealing furnace is less suitable than an oven for this purpose, as it is generally not dimensioned to operate at such low temperatures. This stoving may be carried out in air, wherein the maximum desired temperature is generally not high enough to cause strong oxidation of the surface of the strip or sheet, which the following hydrogenated atmosphere annealings can not remedy.

The reheating temperature should also be determined as a function of the cooling that the strip or the sheet predictably undergoes during its transfer between the heating plant and the rolling plant. The reheating temperature must be sufficient for the actual temperature of the strip or sheet at the time of warm rolling to be the targeted temperature, but it must not exceed 400° C. to avoid significant oxidation of the material during reheating, or even during transfer to the plant.

Of course, the use of a neutral or reducing atmosphere during stoving, or reheating in general, is not excluded.

The limitation of the Si content related to the Al content, taking into account the content of Co, is due to the concern to retain the good cold rolling ability of the material, or at a temperature significantly higher than the ambient temperature, but nevertheless not very high (as for a warm rolling up to 350° C., see above).

The Si content is also governed by the desire to maintain a ferritic structure permanently during the manufacture of the material, which is important in order to obtain the low and isotropic magnetostriction on which the invention is based.

The inventors believe that it is possible that an explanation for the remarkable isotropy of the magnetostriction of the sheets according to the invention lies in the fact that during thermal treatments and cold rolling, the "filiation" or the "heredity" of texture is total, so it is imperative to remain constantly in the ferritic domain.

In using the terms "filiation" or "heredity" of texture, we refer to phenomena that naturally lead to a gradual transformation of the texture of the material during metallurgical operations. In the case of the invention, it turns out that it could be important that this transformation is not disturbed by phase changes that could occur during processing, and thus maintain a "memory" of the initial texture in the material before hot rolling. This is what motivates the inventors to ensure that all the treatments are carried out entirely in the ferritic range of the alloy. It is nevertheless surprising, from the theoretical point of view, that this texture filiation seems to be of importance in order to obtain the low magnetostriction and the magnetostriction isotropy which characterize the invention, even though the method according to the invention only leads at most, to a weak texturing of the material, as will be seen in the examples.

The Cr content may range from traces to 10%. An addition of Cr modifies only very little the stacking fault energy of Fe, and therefore does not significantly modify the texture filiations during the treatments carried out according to the invention. It lowers saturation magnetization $J_{sat}$, while it is not desirable to add an amount exceeding 10% for this reason. On the other hand, just like Si, it substantially increases the electrical resistivity, and therefore advantageously decreases the magnetic losses. Cooling the transformer permits, however, the toleration of more magnetic losses, while a low Cr, or even trace content, may be acceptable in this case.

The total contents of V, W, Mo and Ni are between traces and 4%, preferably between traces and 2%. These elements increase the electrical resistivity, but they lower the saturation magnetization, which one does not generally want.

The Mn content is between traces and 4%, preferably between traces and 2%. The reason for this relatively low maximum content is that Mn reduces the saturation magnetization which is one of the major contributions of FeCo. Mn only slightly increases the electrical resistivity. In particular, it is a gammagenous element, which reduces the temperature range which allows ferritic annealing. We have seen that for questions related to the heredity of ferritic microstructures, it is undesirable to exit the ferritic range during treatments, while an excessive presence of Mn would increase the risks of such an exit. The Al content is between traces and 3%, preferably between traces and 1%. Al reduces saturation magnetization and is much less efficient than Si or Cr for increasing electrical resistivity. But Al may be used to extend the cold rolling ability range of high-alloy FeCo grades when reaching the limits of silicon additions, as previously mentioned.

The S content is between traces and 0.005%. In fact, S tends to form sulphides with manganese and oxysulfides with Ca and Mg, which strongly degrades the magnetic performance and in particular the magnetic losses.

The P content is between traces and 0.007%. In fact, P may form phosphides of metal elements harmful to the magnetic properties and preparation of the microstructure.

The Ni content is between traces and 3%, and preferably less than 0.5%. In fact, Ni does not increase the electrical resistivity, while it reduces the saturation magnetization and thus degrades the power density and the electrical efficiency of the transformer. Its addition is thus not necessary.

The Cu content lies between traces and 0.5%, preferably less than 0.05%. Cu is very poorly miscible in Fe, Fe—Si or Fe—Co, and thus forms copper-rich, non-magnetic phases, significantly degrading the magnetic performance of the material as well as greatly impeding the evolution of its microstructure.

The contents of Nb and Zr are each between traces and 0.1%, preferably less than 0.01% because Nb and Zr are well known to be potent inhibitors of grain growth, and therefore strongly and adversely interfere with the metallurgical mechanism of texture filiation that is suspected to be at the origin of the good results obtained by virtue of the invention.

The Ti content is between traces and 0.2% in order to limit the harmful formation of nitrides, which would significantly degrade the magnetic properties (increased losses), and could interfere with the texture transformation mechanisms during rolling-annealing.

The N content is between traces and 0.01%, again to avoid excessive formation of nitrides of all kinds.

The Ca content is between traces and 0.01% to avoid the formation of oxides and oxysulphides, which would be harmful for the same reasons as Ti nitrides.

The Mg content is between traces and 0.01% for the same reasons as Ca.

The content of Ta is between traces and 0.01% because it may strongly hinder the growth of the grain.

The content of B is between traces and 0.005% to avoid the formation of boron nitrides which would have the same effects as the nitrides of Ti.

The content of O is between traces and 0.01% to prevent the formation of oxidized inclusions in excessive amounts that have the same adverse effects as nitrides.

These maximum levels for S, P, Ni, Cu, Nb, Zr Ti, N, Ca, Mg, Ta, B, O often correspond to mere impurities resulting from the preparation of the alloy, and are common in Fe—Co and Fe—Si type alloys concerned by the invention. If necessary, a rigorous choice of raw materials and careful preparation make it possible to achieve them.

Regarding the manufacturing process that leads to the products according to the invention, it is as follows.

An ingot or a semi-finished continuously cast product, having the composition described above, is prepared. For this purpose, all methods of preparation and casting to obtain this composition may be used. In the case where it is intended to obtain an ingot, methods are recommended such as arc melting under slag, induction melting under slag or in vacuum (VIM for Vacuum Induction Melting). They are preferably followed by remelting processes to obtain a secondary ingot. In particular, the ESR (Electro Slag Remelting) or VAR (Vacuum Arc Remelting) type processes are particularly suitable for obtaining alloys having optimum purity and small fractions of precipitates for the preferred applications of the invention.

In the most general case of obtaining a non-parallelepiped shaped ingot, a first hot forming by forging or rolling (blooming) is conventionally practiced to give it this parallelepiped shape. An ingot is thus obtained which often has a thickness of the order of 10 cm.

The previously shaped ingot or the continuous casting product may be hot rolled in the usual manner until a sheet or strip between 2 to 5 mm thick, preferably between 2 and 3.5 mm thick, is obtained, for example with a thickness of the order of 2.5 mm. This hot rolling is therefore the last step (or the only one) of the hot forming of the method according to the invention.

Then, preferably, a static or continuous annealing of the said sheet or strip is carried out in the ferritic range, i.e. at a temperature of between 650° C., preferably 700° C., and a temperature which guarantees that the purely ferritic range will not be exited and which therefore depends on the composition of the alloy, during 1 minute to 10 hours.

If the Si content is greater than or equal to a noted limit $(\%\ Si)_{\alpha\text{-}lim}$ which depends on the contents of Co and C, then the temperature $T_{tth}$ of this annealing heat treatment may go up to 1400° C. This limit is $(\%\ Si)_{\alpha\text{-}lim}=1.92+0.07\cdot Co(wt\ \%)+58\cdot C(wt\ \%)$.

If the Si content is less than $(\%\ Si)_{\alpha\text{-}lim}$ then the temperature $T_{tth}$ of heat treatment of this annealing is such that $T_{tth}$21 $T_{\alpha\text{-}lim}$ is the upper limit temperature of the presence of ferrite, where $T_{\alpha\text{-}lim}=T_0+k\cdot Si(wt\ \%)$ where $T_0=900+2\cdot Co(wt\ \%)-2833\cdot C(wt\ \%)$ and $k=112-1250\cdot C(wt\ \%)$ These conditions result from a study carried out by the inventors on the phase diagrams of Fe—Co alloys comprising various other alloying elements.

This annealing must be carried out in a dry hydrogenated atmosphere. The atmosphere must contain between 5% and, ideally, 100% hydrogen, wherein the remainder is one or more neutral gases such as argon or nitrogen. Such an atmosphere may result from the use of cracked ammonia. A maximum content of 1% in total of gaseous oxidizing species for the alloy (oxygen, $CO_2$, water vapor . . . ) may be present, preferably less than 100 ppm. The dew point of the atmosphere is at a maximum of +20° C., preferably a maximum of 0° C., more preferably a maximum of −40° C., most preferably a maximum of −60° C.

This hydrogenated, thus reducing, atmosphere effectively acts, as compared to an atmosphere that would be simply neutral, a fortiori which would be oxidizingl:

to prevent oxidation of the surface of the sheet or strip and of the grain boundaries; wherein such an oxidation of the grain boundaries is very unfavorable to the filiation of the texture, and if it is confirmed that one of the reasons for the success of the invention is this very good textural filiation during thermal treatments and cold rolling, it would be an important condition for the implementation of the invention;

to ensure good heat transmission during annealing, especially if it is carried out continuously; $H_2$ is by far the most heat-carrying gas, which it makes it possible to obtain cold-rolled strips without the risk of breakage at the annealing outlet, by avoiding a weakening ordering, thanks to an efficient extraction of heat from the annealed strip in the ordering zone (between 500 and 700° C.).

After this optional but preferred annealing, a natural or forced cooling of the sheet or strip is carried out under conditions which avoid excessive embrittlement of the strip. For a Co content of more than 20%, this cooling speed must be at least 1000° C./h. For a Co content of 20% or less, thus including the case of FeSi alloys of the types concerned by the invention, it is not necessary to set a minimum cooling speed.

The process goes on (either after the optional annealing above, or after the hot rolling), then with a first cold rolling at a reduction rate of 50 to 80%, preferably 60 to 75%, and at a temperature of between room temperature (for example 20° C.) and 350° C. The upper limit of 350° C. corresponds to the case where, as we have seen, "warm" rolling is implemented, wherein the heating is preferably carried out by stoving for alloys relatively rich in Si. Most generally, the temperature for cold rolling is between ambient temperature and 100° C.

A too low reduction rate (less than 50%) in at least one of the cold or "warm" rollings does not, as we shall see, allow the obtaining of the low and isotropic magnetostriction sought. Too high a reduction rate (greater than 80%) would be likely to modify the texture of the material so much that the magnetostriction is degraded.

Then, a static or continuous annealing is carried out, at a temperature plateau between 650 and 930° C., preferably between 800 and 900° C., for 1 min to 24 hours, preferably 2 min to 1 h, in a dry hydrogenated atmosphere (partially or totally) as defined above, for the reasons seen with respect to optional annealing following hot rolling, followed by cooling to be performed under conditions similar to those described for the optional annealing and for the same reasons.

A second cold rolling is then carried out, the characteristics of which are in the same ranges as those already described for the first cold rolling.

Finally, a static or continuous final recrystallization annealing is carried out, under a preferentially hydrogenated atmosphere (partially or totally), such as the atmospheres of the preceding annealings. But this final annealing may also be carried out under vacuum, under neutral gas (argon for example), or even in air, in the ferritic range, at a temperature of 650 to [900+(2×% Co)]° C., for a period of 1 min to 48 hours. A hydrogenated atmosphere is not necessarily essential for this final annealing, because at this stage the metal may have already reached its final dimensions, particularly in thickness, or even in terms of its perimeter, especially if cutting has already taken place to give the pieces of the future stack their final shapes and dimensions. In this case, even if the absence of hydrogen leads to embrittlement of the metal during this recrystallization annealing, it will be without consequence if all that remains to be done is to stack the pieces to form the core.

If the final annealing is prolonged too much, it is possible to obtain, already at 900-930° C. for a Fe—Co alloy, a hollowing of the grain boundaries at the surface of the material which will degrade the magnetic losses, and also oxidation at the grain boundaries, even in the case of a reducing and dry atmosphere, which would have the same effect. Under these conditions, there would be a degradation of the magnetic losses, and the low and isotropic magnetostriction targeted by the invention would also be degraded. A final recrystallization rate of 100% is preferred but is not mandatory, as will be seen in the examples wherein recrystallization rates of 90% may already be sufficient to obtain satisfactory results in terms of low level and isotropy of magnetostriction. It is estimated that 80% is the minimum recrystallization rate required.

The precise conditions for carrying out this final annealing which makes it possible to achieve such recrystallization, for a material of given composition and thickness, may be determined experimentally by persons skilled in the art through routine tests. Static annealing, whose rate of rise in temperature is lower than for continuous annealing and which lasts longer, has the advantage of enlarging the ferritic grain more than continuous annealing, which is favorable to obtaining low magnetic losses.

Preferably, this final annealing is concluded by a relatively slow cooling such as natural cooling in air, or cooling under a hood or other device to limit the thermal losses by radiation. A speed less than or equal to 2000° C./h, preferably less than or equal to 600° C./h, is typically recommended. Faster cooling could introduce internal stresses by establishing a thermal gradient in the material, which would degrade the magnetic losses.

These conditions guaranteeing sufficiently slow cooling are most easily fulfilled, especially when the final annealing is static annealing, i.e. carried out in a vacuum, wherein the material is simply left in the treatment chamber during its cooling.

Cooling after annealing other than the final annealing has no special advantage in being performed at a low speed. Too slow cooling could even reduce the rollability of the material in the next step.

This relatively slow cooling is preferably coupled to a temperature rise speed for annealing which is also less than or equal to 2000° C./h, more preferably less than or equal to 600° C./h.

In addition, in general, the inventors believe that in order not to obtain a too marked Goss or other texture, but to obtain a good filiation of texture, the speed of rise in temperature for the final annealing and the rate of cooling which follows this final annealing, are among the parameters that may be used to achieve the desired objectives in terms of low and isotropic magnetostriction of the alloys used in the invention, in addition to the composition of the alloy and the conditions of its thermal and thermomechanical treatments during cold or warm rolling and annealing.

The inventors believe it preferable to obtain on the final product not more than 30% of Goss texture component or of {111}<110> texture component (these are the orientations which are most present in the sheets and strips according to the invention) and, in general, not more than 30% of any noteworthy {hkl}<uvw> texture component, i.e. a component characterized by the fact that at most 30% of the volumetric fraction of the grains of the material have the {hkl}<uvw> orientation, to less than 15° in disorientation from a specific $\{h_0k_0l_0\}\langle u_0v_0w_0\rangle$ orientation.

After the final recrystallization annealing which makes it possible to obtain the final magnetic properties of the material, a supplementary oxidation annealing of the material may be added at a temperature between 400 and 700° C., preferably between 400 and 550° C., allowing a strong but superficial oxidation of the material on at least one of its faces, without the risk of intergranular oxidation, since this is known to occur at higher temperatures. This oxidation layer has a thickness of 0.5 to 10 μm and guarantees electrical isolation between the stacked parts of the transformer magnetic core, allowing a substantial reduction in the induced currents and thus in the magnetic losses of the transformer. The precise conditions for obtaining this oxidation layer may easily be determined by persons skilled in the art using conventional experiments, as a function of the precise composition of the material and the oxidizing power of the chosen treatment atmosphere. (air, pure oxygen, oxygen-neutral gas mixture . . . ) with respect to this material. Conventional analyses of the composition of the oxidation layer and its thickness make it possible to determine for which treatment conditions of a given material (temperature, duration, atmosphere) may the desired oxidation layer be obtained.

A manufacturing method has been described comprising two cold rolling steps and two or three annealing steps. But it remains in accordance with the scope of the invention to perform more cold rolling steps similar to those described, and which may be separated by intermediate annealings similar to the first mandatory annealing described.

It should be understood that each of the cold rollings with a reduction rate of 50 to 80%, preferably 60 to 75%, to which reference has been made, may be performed gradually, in several successive passes not separated by an intermediate annealing.

The final result is a cold-rolled annealed sheet or strip whose thickness is typically 0.05 to 0.3 mm, preferably at most 0.25 mm, more preferably at most 0.22 mm in order to limit the magnetic losses, which has the particularity of presenting very low magnetostrictions λ in the three directions DL (rolling direction), DT (transverse direction) and 45° (median direction between DL and DT), measured both parallel and perpendicularly to the direction of the applied field, and especially a very small difference between the highest and the lowest magnetostrictions of those measured, and for different inductions from 1.2 T to 1.8 T. These inductions are those at which it is often desirable to operate on-board aircraft transformers using Fe—Co or Fe—Si cores to obtain, in addition to low magnetostriction and low inrush effect, as reduced a transformer mass as possible. 1.8 T, in particular, is an interesting induction to obtain a transformer as light and as quiet as possible.

It is understood that in order to obtain low magnetostrictive noise of the transformer, it would be of little use to obtain a low magnetostriction only in one or certain directions that would be defined with respect to the direction of rolling and the direction of the field, while retaining a relatively strong magnetostriction in the other directions. Thus, the criterion of user satisfaction is the maximum deviation "Max Δλ" between the magnetostriction amplitudes observed during measurements made on three types of sample from the same material and represented in FIG. 1. The following examples are based on this evaluation method.

These samples are taken from a strip 1 prepared according to the invention or according to a reference method, based on the example. Its rolling direction DL, its transverse direction DT and its median direction 45° are represented by arrows. Three types of samples are taken from sheet 1 for carrying out the magnetostriction tests. Type 1: elongated rectangular samples 2 (e.g. 120×15 mm) cut so that the LONG direction of sample 2 is parallel to DL. The magnetic field Ha is applied during the deformation measurement by an excitation coil with the same axis as the LONG direction of the sample 2, thus also in the LONG direction of the sample 2. The deformation measurements ε, called $\lambda^{H//DL}$, are carried out both in the direction of the field ($\lambda^{H//DL}{}_{e//H}$) and perpendicular to it ($\lambda^{H//DL}{}_{e\perp H}$) which thus results in two magnetostriction values for sample 2 of type 1.

Type 2: elongated rectangular samples 3 (e.g. 120×15 mm) cut so that the LONG direction of sample 3 is parallel to the 45° axis of DL and DT. The magnetic field Ha is applied during the deformation measurement, by an excitation coil on the same axis as the LONG direction of the sample 3, which is also in the LONG direction of the sample 3. The deformation measurements, called $\lambda^{H//45°}$, are carried out both in the direction of the field ($\lambda^{H//45°}{}_{e//H}$), and perpendicular to it ($\lambda^{H//45°}{}_{e\perp H}$) and therefore results in two magnetostriction values for sample 3 of type 2.

Type 3: elongated rectangular samples 4 (e.g. 120×15 mm) cut so that the LONG direction of the sample 4 is parallel to DT. The magnetic field Ha is applied during the deformation measurement, by an excitation coil with the same axis as the LONG direction of the sample 4, which is also in the LONG direction of the sample 4. The deformation measurements, called $\lambda^{H//DT}$, are performed both in the direction of the field ($\lambda^{H//DT}{}_{e//H}$)and perpendicular to it ($\alpha^{A//DT}{}_{e\perp H}$) and therefore result in two magnetostriction values for the sample 4 of type 3.

A total of six different deformation measurements are thus measured at each induction level B (measured) of each of the three sample types. To find out the magnetosctrictive behavior of the material, not only three directions (types) of sample collection are used (DL, DT and the direction making an angle of 45° with DL and DT), but also several levels of induction such as, for example 1T, 1.5T, 1.8T.

The value Max Δλ, measured for an induction amplitude B in the material and which may also be called Max Δλ(B), is representative of the isotropy of the magnetostriction. It is therefore calculated by taking into account the highest value and the lowest value among these six values of λ measured on the samples 2, 3, 4 coming from the same strip 1 of material as indicated in FIG. 1. This is the highest value that may be found among the six absolute values of the algebraic differences between each possible pair of magnetostriction measurements described above. In other words :

$$\mathrm{Max}\Delta\lambda(B) = \mathrm{Max}\left|\lambda^{H//i}_{\varepsilon//H}(B) - \lambda^{H//j}_{\varepsilon\perp H}(B)\right|_{i,j=DL,45°\ ou DT}$$

For a sheet or a strip to be declared in conformity with the invention, it is agreed that the maximum value Max Δλ measured for an induction of 1.8 T must be at most 25 ppm.

The ten tests that will be described have been carried out in particular on samples of an FeCo27-type alloy, the detailed compositions of which will be indicated. But it will be seen that the invention would be applicable quite comparably to all the alloys in this category which is known and commonly used in transformer cores, while the texturing that is very low but not zero that will be described along, with the means to obtain it, had so far not been identified. Table 1 shows the compositions of various alloys according to the invention and of the reference alloys used in the tests.

In particular, two FeCo27 alloys from different castings, but having very similar compositions were tested so that the test results are directly comparable. The alloy A was used for the reference tests 1 and 2, the alloy B was used for the tests according to the invention 3 to 9 and for the reference tests 10 to 12.

TABLE 1

Compositions of the test alloys

| Element (%) | A Invention | B Invention | C Invention | D Invention | E Invention | F Invention | G Invention | H Invention | I Invention | J Reference | K Reference | L Reference | M Invention | N Invention |
|---|---|---|---|---|---|---|---|---|---|---|---|---|---|---|
| C | 0.010 | 0.009 | 0.007 | 0.023 | 0.012 | 0.013 | 0.011 | 0.012 | 0.010 | 0.008 | 0.009 | 0.009 | 0.012 | 0.015 |
| Mn | 0.261 | 0.256 | 0.195 | 0.234 | 0.248 | 0.421 | 0.532 | 0.810 | 0.167 | 0.208 | 0.520 | 0.289 | 0.368 | <0.010 |
| Si | 0.142 | 0.153 | 0.330 | 0.720 | 0.031 | 2.730 | 0.070 | 0.013 | 3.020 | 0.023 | 3.07 | 1.53 | 0.640 | 0.083 |
| S | 0.0023 | 0.0042 | 0.0033 | 0.0021 | 0.0048 | 0.0008 | 0.0006 | 0.0028 | 0.0005 | 0.0015 | 0.0007 | 0.0044 | 0.0008 | <0.0005 |
| P | 0.0025 | 0.0055 | 0.0031 | 0.0029 | 0.0029 | 0.0032 | 0.0047 | 0.0037 | 0.0053 | 0.0031 | 0.0043 | 0.0049 | 0.0041 | <0.0005 |
| Ni | 0.030 | 0.030 | 0.100 | <0.01 | 0.130 | <0.01 | <0.01 | <0.01 | <0.01 | <0.01 | <0.01 | <0.01 | 0.080 | <0.01 |
| Cr | 0.514 | 0.498 | 1.00 | 0.200 | 0.011 | 0.008 | 0.048 | 6.06 | 0.047 | 0.089 | 0.007 | 0.038 | 0.072 | <0.01 |
| Mo | <0.005 | <0.005 | <0.005 | <0.005 | <0.005 | <0.005 | <0.005 | 0.170 | <0.005 | <0.005 | <0.005 | <0.005 | <0.005 | <0.005 |
| Cu | 0.009 | 0.010 | <0.005 | <0.005 | <0.005 | <0.005 | <0.005 | <0.005 | <0.005 | <0.005 | <0.005 | <0.005 | <0.005 | <0.005 |
| Co | 27.09 | 27.32 | 18.35 | 10.07 | 4.21 | 0.020 | <0.01 | 27.11 | <0.01 | 49.0 | 18.20 | 38.15 | 38.82 | 15.10 |
| V | 0.01 | 0.01 | <0.005 | 0.51 | <0.005 | <0.005 | <0.005 | <0.005 | <0.005 | 2.03 | <0.005 | <0.005 | <0.005 | <0.005 |
| Al | <0.001 | <0.001 | 0.14 | <0.001 | <0.001 | 0.60 | <0.001 | <0.001 | <0.001 | <0.001 | <0.001 | <0.001 | <0.001 | <0.001 |
| Nb | <0.001 | <0.001 | <0.001 | <0.001 | 0.005 | <0.001 | <0.001 | <0.001 | <0.001 | 0.040 | <0.001 | <0.001 | <0.001 | <0.001 |
| Ti | <0.001 | <0.001 | <0.001 | 0.080 | <0.001 | <0.001 | <0.001 | <0.001 | <0.001 | <0.001 | <0.001 | <0.001 | <0.001 | <0.001 |
| N | 0.0015 | 0.0044 | 0.0023 | 0.0036 | 0.0043 | 0.0027 | 0.0041 | 0.0045 | 0.0048 | 0.0018 | 0.0021 | 0.0019 | 0.0027 | 0.0012 |
| Ca | <0.0003 | <0.0003 | <0.0003 | 0.0013 | <0.0003 | <0.0003 | 0.0009 | <0.0003 | <0.0003 | 0.0007 | 0.0015 | <0.0003 | 0.0009 | <0.0003 |
| Mg | <0.0002 | <0.0002 | 0.0006 | <0.0002 | <0.0002 | 0.0005 | 0.0004 | <0.0002 | <0.0002 | 0.0004 | <0.0002 | 0.0004 | <0.0004 | <0.0002 |
| Ta | <0.002 | <0.002 | 0.0025 | <0.002 | <0.002 | <0.002 | <0.002 | <0.002 | <0.002 | <0.002 | <0.002 | <0.002 | <0.002 | <0.002 |
| B | <0.0005 | <0.0005 | <0.0005 | <0.0005 | <0.0005 | <0.0005 | <0.0005 | 0.0007 | <0.0005 | <0.0005 | <0.0005 | <0.0005 | <0.0005 | <0.0005 |
| W | <0.005 | <0.005 | <0.005 | <0.005 | 0.28 | <0.005 | <0.005 | <0.005 | <0.005 | <0.005 | <0.005 | <0.005 | <0.010 | <0.010 |
| Fe | 71.93 | 71.70 | 79.87 | 88.15 | 95.06 | 96.20 | 99.33 | 65.81 | 96.75 | 48.59 | 78.19 | 59.97 | 60.00 | 84.80 |

Samples of alloys A and B were prepared as follows.

The alloy was prepared in a vacuum induction furnace and then cast in the form of a frustoconical ingot of 30 to 50 kg, with a diameter of 12 cm to 15 cm and a height of 20 to 30 cm.

It was then rolled on a roughing mill to a thickness of 80 mm, and then hot rolled at a temperature of about 1000° C. to a thickness of 2.5 mm.

These hot-rolled products were then subjected to cold annealing and cold rolling (LAF) at less than 100° C. under the following conditions:

Sample 1: LAF 1 at 84% reduction rate; continuous annealing 1 at 1100° C. for 3 min; LAF 2 at a 50% reduction rate; static annealing 2 at 900° C., 1 h;

Sample 2: LAF 1 at 84% reduction rate; continuous annealing 1 at 1100° C. for 3 min; LAF 2 at a 50% reduction rate; static annealing 2 at 700° C., 1 h;

Sample 3: continuous annealing 1 at 900° C. for 8 minutes; LAF 1 at 70% reduction rate; continuous annealing 2 for 8 min at 900° C.; LAF 2 at 70% reduction rate; static annealing 3 at 660° C., 1 h;

Sample 4: continuous annealing 1 at 900° C. for 8 minutes; LAF 1 at 70% reduction rate; continuous annealing 2 at 900° C. for 8 min; LAF 2 at 70% reduction rate; static annealing 3 at 680° C., 1 h;

Sample 5: continuous annealing 1 at 900° C. for 8 min; LAF 1 at 70% reduction rate;

annealing 2 at 900° C. for 8 min; LAF 2 at 70% reduction rate; static annealing 3 at 700° C., 1 h;

Sample 6: continuous annealing 1 at 900° C. for 8 minutes; LAF 1 at 70% reduction rate; continuous annealing 2 at 900° C. for 8 min; LAF 2 at 70% reduction rate; static annealing 3 at 720° C., 1 h;

Sample 7: continuous annealing 1 for 8 min at 900° C.; LAF 1 at 70% reduction rate; continuous annealing 2 for 8 min at 900° C.; LAF 2 at 70% reduction rate; static annealing 3 at 750° C., 1 h;

Sample 8: continuous annealing 1 for 8 min at 900° C.; LAF 1 at 70% reduction rate; continuous annealing 2 for 8 min at 900° C.; LAF 2 at 70% reduction rate; static annealing 3 at 810° C., 1 h.

Sample 9: continuous annealing 1 for 8 min at 900° C.; LAF 1 at 70% reduction rate; continuous annealing 2 for 8 min at 900° C., LAF 2 at 70% reduction rate; static annealing 3 at 900° C., 1 h.

Sample 10: continuous annealing 1 for 8 min at 900° C.; LAF 1 at 70% reduction rate; continuous annealing 2 for 8 min at 900° C.; LAF 2 at 70% reduction rate; static annealing 3 at 1100° C., 1 h.

Sample 11: continuous annealing 1 for 8 min at 900° C.; LAF 1 at 80% reduction rate; continuous annealing 2 for 8 min at 900° C.; LAF 2 at 40% reduction rate; static annealing 3 at 700° C., 1 h.

Sample 12: continuous annealing 1 for 8 min at 900° C.; LAF 1 at 70% reduction rate; continuous annealing 2 at 1100° C. for 8 min; LAF 2 at 70% reduction rate; static annealing 3 at 700° C., 1 h.

The static annealings concluding the preparation were, for all the samples, preceded by a rise in temperature at a speed of 300° C./s and followed by a cooling at a speed of the order of 200° C./h, carried out simply by leaving the samples in the annealing furnace. The rates of rise in temperature before the final annealing and cooling after the final annealing were therefore relatively moderate, which contributed in all cases to the obtaining of a final product relatively little textured, as will be seen in Table 2. The differences in magnetostriction and isotropy observed for the samples according to the invention and the reference samples may thus be attributable to other factors, and in particular to the fact that, for the reference samples, there was a passage in the austenitic range during annealing.

It should be noted that final annealing tests carried out at 850° C. for 3 h in another static oven, under a hydrogen atmosphere, with parameters comparable to those of the tests described here, but with a cooling rate after final annealing still lower (60° C./h), gave very similar results concerning the level of magnetostriction and its isotropy. The cooling after final annealing may therefore be particularly slow without disadvantages.

All the annealings of all the samples were carried out under a pure and dry hydrogen atmosphere with a dew point of less than −40° C. No other gaseous species were present at more than 3 ppm.

Thus, the reference samples 1 and 2 were cold-rolled directly after the heat treatments, followed by high-temperature annealing (1100° C.) in the austenitic range, followed by a second cold rolling, and finally a final annealing at 900° C. (test 1) or 700° C. (test 2) in the ferritic range.

The samples according to the invention 3 to 9 began, after the heat treatments, to undergo annealing at 900° C., then a first cold rolling, then a second annealing at 900° C., then a second cold rolling, and then a cold rolling, and a final annealing at a variable temperature from 660 to 900° C. according to the tests. All the annealings thus took place in the ferritic range in accordance with the invention, and were three in number, compared with two for the first two reference samples 1 and 2. All the cold-rollings were carried out with a reduction rate of 70%.

The reference sample 10 was first annealed in the ferritic range at 900° C. like the samples according to the invention and unlike the other two reference samples, followed by a first cold rolling and then an intermediate annealing at 900° C. and thus in the ferritic range, then a second cold rolling, then a final annealing at a temperature of 1100° C. and thus in the austenitic range. It has thus been subjected to a treatment comparable to that of samples 3 to 9 according to the invention, apart from the fact that the final annealing took place in the austenitic range. All the cold rollings were performed at 70% reduction rate, like the samples according to the invention.

not according to the invention, instead of 70% as all the samples 3 to 10, then a final annealing at a temperature of 700° C. and thus in the ferritic range.

The reference sample 12 is quite similar to the sample 10, due to its passage through the austenitic range, which, however, takes place at a different stage of the treatment. It first underwent ferritic annealing at 900° C., just like the samples according to the invention and unlike the first two reference samples, then a first cold rolling, then an intermediate annealing in the austenitic range at 1100° C. and thus not in accordance with the invention, then a second cold rolling, and then a final annealing at a temperature of 700° C. and thus in the ferritic range. It was thus subjected to a treatment comparable to that of samples 3 to 9 according to the invention, apart from the fact that the intermediate annealing took place in the austenitic range. All its cold rollings were performed at 70% reduction rate, like the samples according to the invention.

The characteristics of the different samples thus obtained, in terms of the presence of a Goss or {111}<110> texture measured by X-rays, of mean diameter of the grains measured by image analysis of the samples, characterized by electron backscatter diffraction (EBSD), and recrystallized fraction, measured at the surface by the same EBSD technique, and assuming that the surface fraction is the volume fraction, are summarized in Table 2.

TABLE 2

Texture, grain diameter and recrystallization rate of the tested samples according to their treatment conditions

| Test | Reduction rate of the cold rollings | Final annealing temperature (° C.) | Alloy | % Goss texture | % {111}<110> texture | Grain diameter (μm) | Recrystallized fraction |
|---|---|---|---|---|---|---|---|
| 1 Reference | 84/50% | 900 (but annealing 1 at 1100° C.) | A | 10 | 10 | 150 | 100% |
| 2 Reference | 84/50% | 700 (but annealing 1 at 1100° C.) | A | 7 | 10 | 15 | 100% |
| 3 Invention | 70/70% | 660 | B | 10 | 10 | 16 | 90% |
| 4 Invention | 70/70% | 680 | B | 9 | 11 | 18 | 95% |
| 5 Invention | 70/70% | 700 | B | 10 | 12 | 20 | 100% |
| 6 Invention | 70/70% | 720 | B | 10 | 11 | 23 | 100% |
| 7 Invention | 70/70% | 750 | B | 12 | 10 | 26 | 100% |
| 8 Invention | 70/70% | 810 | B | 13 | 11 | 44 | 100% |
| 9 Invention | 70/70% | 900 | B | 12 | 15 | 95 | 100% |
| 10 Reference | 70/70% | 1100 (annealings 1 and 2 at 900° C.) | B | 4 | 7 | 285 | 100% |
| 11 Reference | 80/40% | 700 | B | 17 | 8 | 22 | 100% |
| 12 Reference | 70/70% | 700 (but annealing 2 at 1100° C.) | B | 6 | 11 | 21 | 100% |

The reference sample 11, after the heat treatments, was annealed at 900° C., then underwent a first cold rolling at 80% instead of 70% as all the samples 3 to 10 (which remains in accordance with the invention), then a second annealing at 900° C., then a second cold rolling at 40%, thus The various ranges of metallurgical treatments applied led to substantially identical final grain sizes between the references and the tests according to the invention, i.e. a grain size range of about 300 to 15 μm: more precisely from 16 to 95 μm for the tests according to the invention, i.e. when all the annealings have been carried out in the ferritic range; from 15 to 285 μm for the references, i.e. when at least one step of the process goes beyond the ferritic range. It may thus be seen that the grain size range is similar and has no link with the low magnetostrictions obtained. But the test 2, the final annealing of which was performed at 700° C., led to a grain size significantly lower than that of the reference tests 1 and 10 and of test 9 according to the invention, and which is of the same order of magnitude as those of the tests 3 to 8 according to the invention, which were also carried out at temperatures in the region of 700° C. In general, the metallurgical ranges of the tests according to the invention provide a grain size (between 16 and 95 μm according to the tests) relatively close to that of the reference tests, and, in any case, quite consistent with what could be expected a priori, especially given the conditions of the final annealing. It should be noted that carrying out an annealing at 900° C. before the first cold rolling in the tests according to the invention and the reference test 10 does not substantially affect, on its own, the size of the grains obtained as the result of the whole process compared to the reference tests 1 and 2 where the cold rolling was carried out directly on the hot-rolled sample.

More surprisingly, the significant differences between the treatment ranges of the different tests did not lead to very significant differences in the final textures of the materials, from the point of view of the proportion of Goss texture and the proportion of {111}<110> texture.

Then the magnetostrictions (measured in ppm) on the various cut samples 1 to 3, 5, 7 to 12, according to the different directions DL, DT and 45° of DL and DT as indicated in FIG. 1 (the direction mentioned is the direction of the sheet upon which the large side of the rectangular sample is located), were observed and measured either parallel to the large side of the sample (thus also parallel to the direction of the applied magnetic field and the magnetic flux of the generated induction B) and denoted "//H", i.e. perpendicularly to the large side of the sample (and therefore perpendicular to the direction of the applied magnetic field and the magnetic flux of generated induction B) and denoted "⊥H". The measurements were carried out continuously over a wide range of B and exploited precisely for three amplitudes of B magnetic induction: 1.2 T, 1.5 T and 1.8 T. The results are summarized in Table 3, where the different samples are designated by their composition A or B and by the temperature of their final annealing. The measurements on samples 4 and 6 were not carried out, but it is certain that they would have been very comparable to those of the samples according to the invention treated at final annealing temperatures close to theirs.

TABLE 3

Results of magnetostriction tests

| Test | Sample test (composition, final annealing temperature) | Measuring direction of magnetostriction deformation ε | B = 1.2 T $\lambda^{H//DL}$ (ppm) | B = 1.2 T $\lambda^{H//45°}$ (ppm) | B = 1.2 T $\lambda^{H//DT}$ (ppm) | B = 1.5 T $\lambda^{H//DL}$ (ppm) | B = 1.5 T $\lambda^{H//45°}$ (ppm) | B = 1.5 T $\lambda^{H//DT}$ (ppm) | B = 1.8 T $\lambda^{H//DL}$ (ppm) | B = 1.8 T $\lambda^{H//45°}$ (ppm) | B = 1.8 T $\lambda^{H//DT}$ (ppm) | Max Δλ 1.2 T | Max Δλ 1.5 T | Max Δλ 1.8 T |
|---|---|---|---|---|---|---|---|---|---|---|---|---|---|---|
| 1 | A, 900° C. | //H | +4.5 | +3 | +11 | +9 | +5 | +18 | +12 | +10 | +22 | 31 | 44 | 66.5 |
| | | ⊥H | −1.5 | −4 | −20 | −5 | −10.5 | −35 | −11 | −17.5 | −44.5 | | | |
| 2 | A, 700° C. | // H | +1.2 | +7 | +8 | +21 | +13 | +14 | +30 | +21 | +21.5 | 22 | 38.5 | 54 |
| | | ⊥H | −10 | −4 | −4.5 | −17.5 | −8 | −9 | −24 | −14 | −14 | | | |
| 3 | B, 660° C. | // H | 0 | +2 | 0 | +5 | +9 | +2.5 | +10 | +12.5 | +8 | 4 | 15 | 20.5 |
| | | ⊥H | 0 | −2 | 0 | −2 | −6 | −2 | −5.5 | −8 | −6 | | | |
| 5 | B, 700° C. | // H | 0 | 0 | 0 | +0.5 | 0 | 0 | +5 | +4.5 | +3 | 0 | 2.5 | 10 |
| | | ⊥H | 0 | 0 | 0 | −0.5 | −2 | 0 | −5 | −5 | −2.5 | | | |
| 7 | B, 750° C. | // H | 0 | 0 | +1 | 0 | +1 | +1.5 | +2 | +5 | +6 | 1 | 2.5 | 9 |
| | | ⊥H | 0 | 0 | 0 | 0 | −1 | −0.4 | −0.5 | −3 | −2 | | | |
| 8 | B, 810° C. | // H | 0 | 0 | 0 | 0.5 | +2 | +3 | +4.5 | +5.5 | +7.5 | 0 | 6 | 15 |
| | | ⊥H | 0 | 0 | 0 | 0 | −1 | −3 | −3 | −4.5 | −7.5 | | | |
| 9 | B, 900° C. | // H | 0 | −1 | 0 | 0 | −2 | 0 | −1 | −1.5 | +2.5 | 1.5 | 3 | 5 |
| | | ⊥H | 0 | 0.5 | 0 | 0.5 | +1 | 0 | +1 | 0 | −2.5 | | | |
| 10 | B, 1100° C. | // H | +10 | +13 | +9.5 | +17 | +22.5 | +17 | 22.5 | +31 | +25.5 | 20.5 | 34.5 | 47 |
| | | ⊥H | −7.50 | −7 | −6.50 | −12 | −10 | −10 | −16 | −14 | −14.5 | | | |
| 11 | B, 700° C. | // H | 15 | 8.5 | 13 | 25 | 14 | 21.5 | 38 | 23 | 27 | 25 | 38.5 | 57.5 |
| | | ⊥H | −8 | −3 | −10 | −12 | −7 | −17 | −18.5 | −12.5 | −19.5 | | | |
| 12 | B, 700° C. | // H | 8 | 9 | 10 | 14.5 | 15 | 15.5 | 22 | 22 | 22.5 | 15.5 | 25.5 | 36.5 |
| | | ⊥H | −4.5 | −5 | −5.5 | −9 | −9.5 | −10 | −14 | −14 | −14 | | | |

There are very large differences in magnetostriction measurements in terms of absolute value and isotropy, between the reference tests 1, 2 for which the first annealing was carried out in the austenitic range, and the tests according to the invention 3 to 9 where all the annealings were carried out in the ferritic range, including the optional annealing preceding the first cold rolling, but not carried out in the reference tests 1 and 2.

We also see, according to the test 10, that by exiting only at the end of the process to the ferritic phase through a final annealing performed in the austenitic range, the low and isotropic magnetostriction target is also not obtained, although here too, a ferritic annealing was carried out before the first cold rolling.

The reference test 11 shows that the low and isotropic magnetostriction target is also not obtained when one of the cold rollings is carried out at a low reduction rate, even if all annealing takes place in the ferritic range.

The reference test 12 shows that the low and isotropic magnetostriction target is also not obtained when the second of the three annealings is performed in the austenitic range. The reference examples 1 and 2 had austenitic annealing performed at the start of treatment after the first cold rolling, while the reference example 10 had austenitic annealing performed at the very end of treatment. Example 12 thus completes the demonstration of the harmfulness of the austenitic annealing regardless of its position in the treatment.

FIGS. 2 to 12 highlight these differences.

Figure 2:
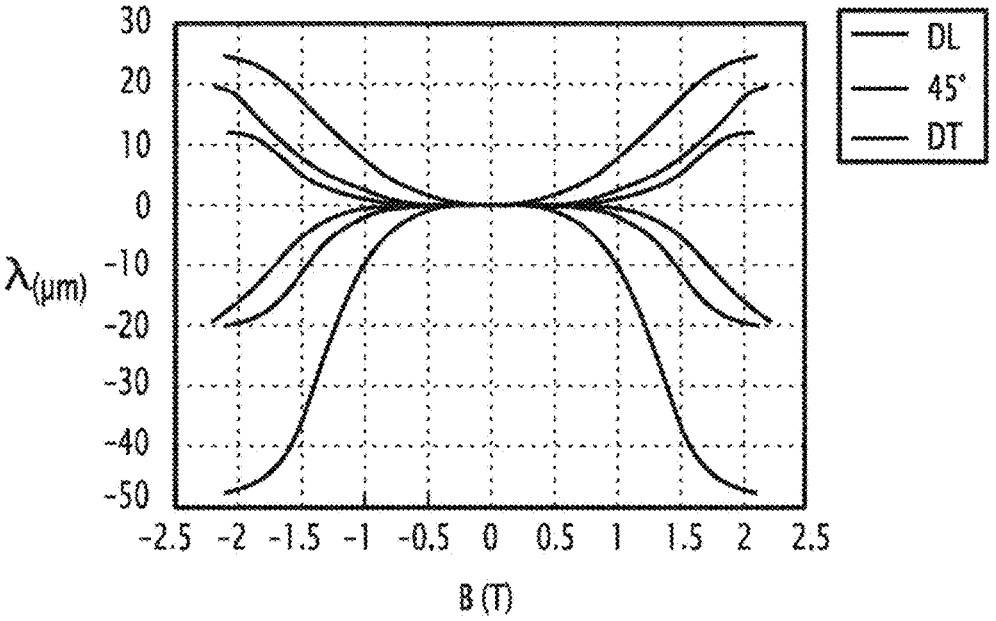
FIGS. 2, 3, 10, 11 and 12 show the magnetostriction curves, as a function of the intensity of the magnetic field in various directions, of samples of an FeCo27 alloy obtained by methods not in accordance with the invention.

FIG. 2 shows the magnetostriction results observed during the reference test 1. It may be seen that even for low inductions of the order, in absolute value, of 0.5 T, the magnetostriction according to DT begins to become significant and increases very rapidly with induction. For DL and for the 45° direction as compared to DT and DL, it is from about 1 T that the magnetostriction begins to increase substantially and rapidly. This leads to significant magnetostriction deformations of up to several tens of ppm in certain directions at inductions of the order of 2 T, and to a strong anisotropy of these deformations, all in the direction of the creation of a magnetostriction noise that is too intense for the preferred applications of the invention.

Figure 3:
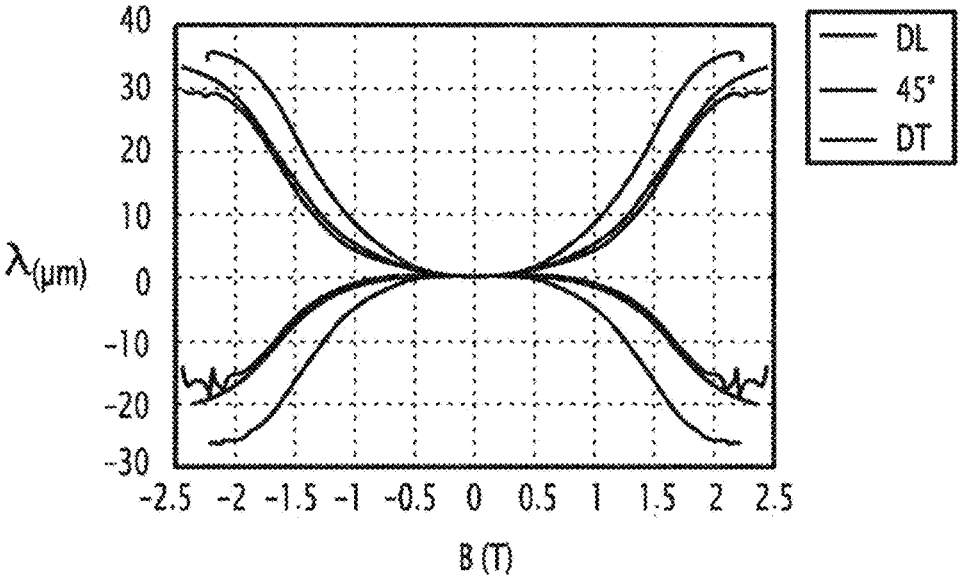

FIG. 3 shows the magnetostriction results observed during the reference test 2. It is observed that, compared to the test 1, the isotropy of the magnetostriction is a little improved, and certain extreme values of the magnetostriction are a little less. But from an induction of 1 T, the magnetostriction begins to become significant in the three directions considered. The material thus obtained would therefore not be well suited, either, for the preferred applications of the invention. The significantly smaller grain size in the test 2 sample compared with the test 1 sample therefore did not substantially improve the magnetostriction results.

Figure 4:
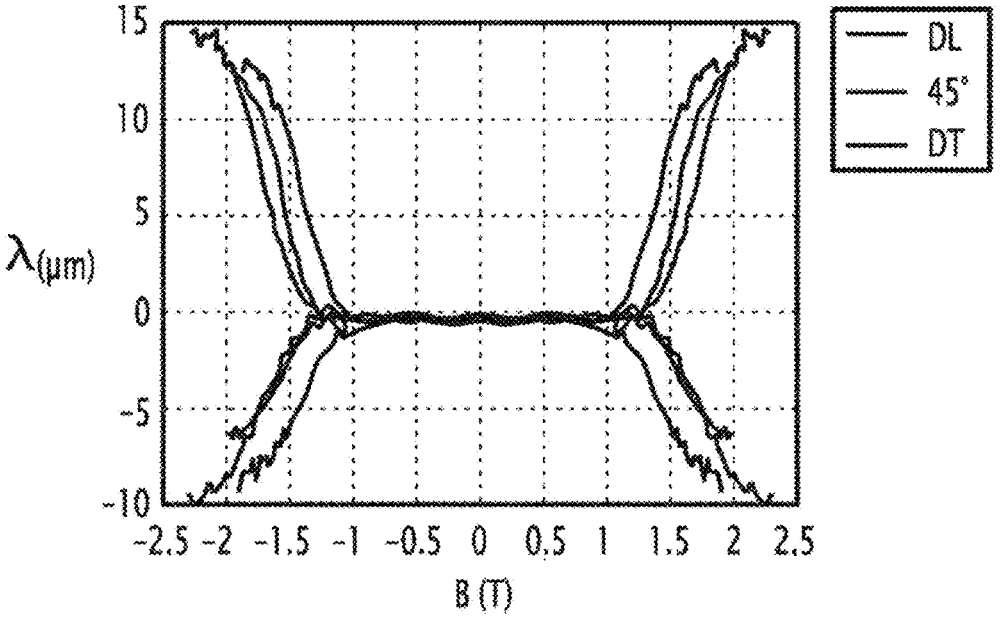
FIGS. 4 to 9 which show the magnetostriction curves, as a function of the intensity of the magnetic field in various directions, of FeCo27 alloy samples obtained by methods in accordance with the invention.

FIG. 4 shows the magnetostriction results observed during test 3 according to the invention. In this case, the shape of the curves changes radically. On the one hand, we observe a magnetostriction which remains practically nil in all the considered directions up to induction values exceeding 1 T by a little. And when this magnetostriction begins to increase for higher fields, its value remains very significantly lower than in the reference tests 1 and 2. In addition, the magnetostriction differences between the different directions remain relatively small, even for the high fields. At 2 or -2 T, we have a magnetostriction which does not reach 15 ppm or −10 ppm, and this in the case of all considered directions. These results are therefore very significantly better than for the reference tests, and they are sufficient to make the materials thus prepared capable of constituting, in particular, cores of low noise aircraft transformers.

Figure 5:
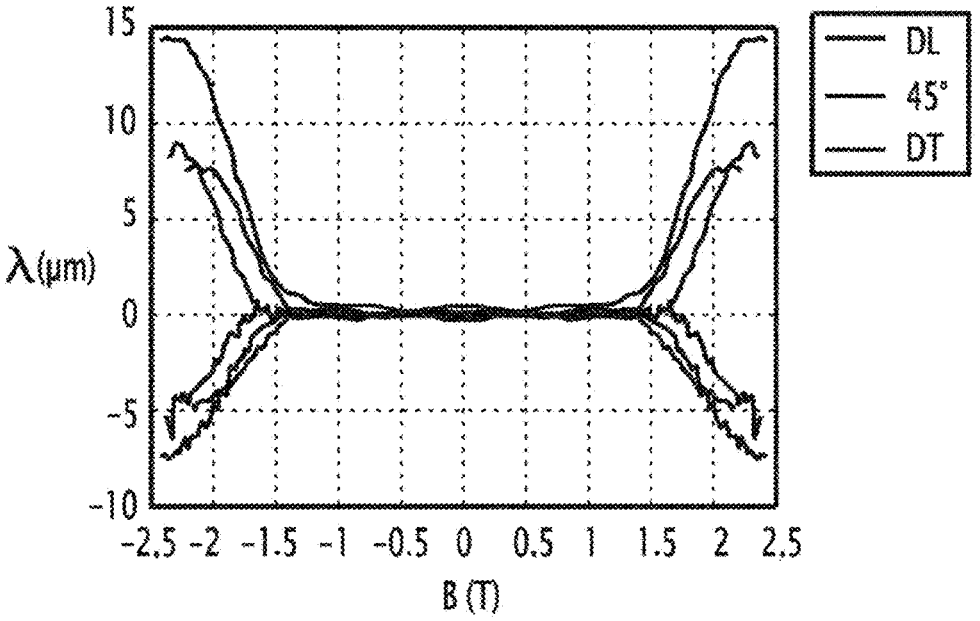

FIG. 5 shows the magnetostriction results observed during the test 7 according to the invention. We find magnetostriction curves that are qualitatively very similar to those of the test 3 (FIG. 4), with, in addition, a magnetostriction that starts to become significant only for inductions of at least ±1.5 T. At ±2 T, the magnetostriction may be less than 5 ppm and never exceed 10 ppm. Thus, excellent results are obtained in this test, which differs from test 3 only in its final annealing temperature of 750° C. instead of 660° C., and which led to a total recrystallization whereas it was only 90% in test 3.

Figure 6:
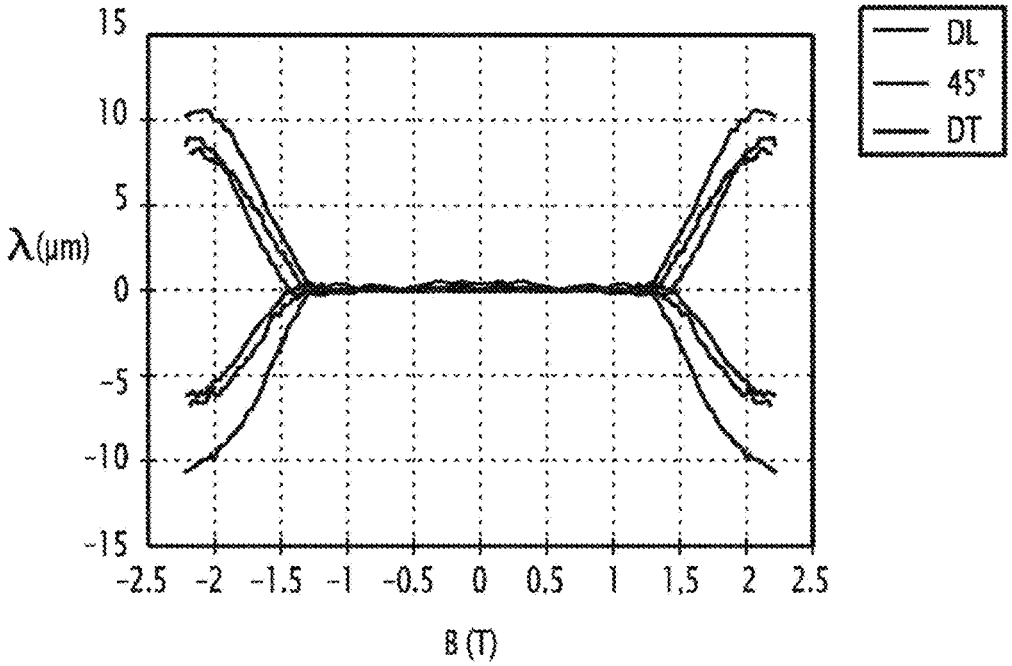

FIG. 6 shows the magnetostriction results observed during the test 8 according to the invention, which had a final annealing temperature of 810° C. We find magnetostriction curves qualitatively very comparable to those of the test 3 (FIG. 4) and the test 7 (FIG. 5). Quantitatively, the results are good, with maximum values of magnetostriction which remain of the order of ±10 ppm even for inductions of ±2 T, and a Max $\Delta\lambda$ of 15 ppm to 1.8T.

Figure 7:
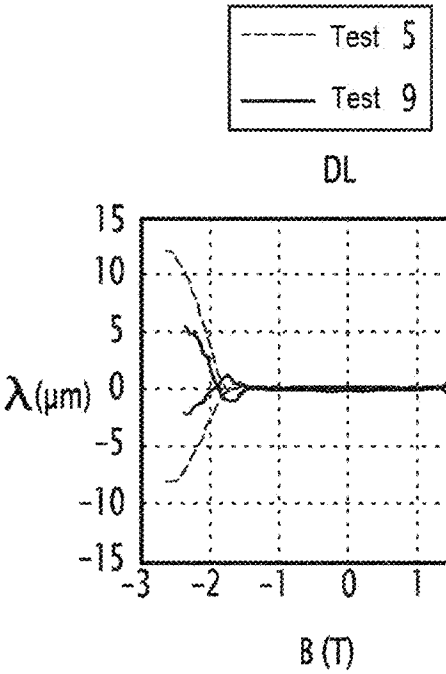
Figure 8:
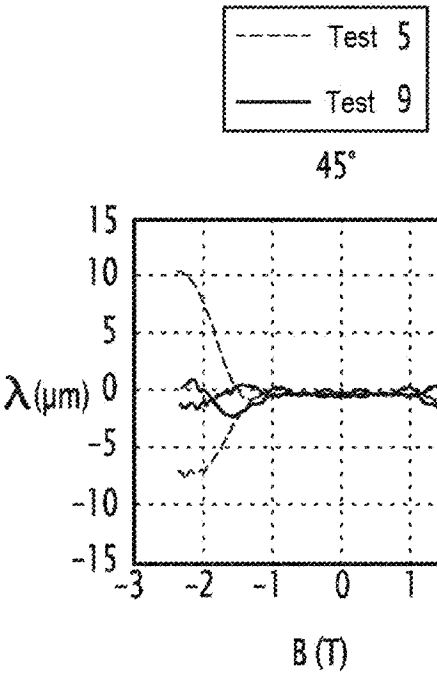
Figure 9:
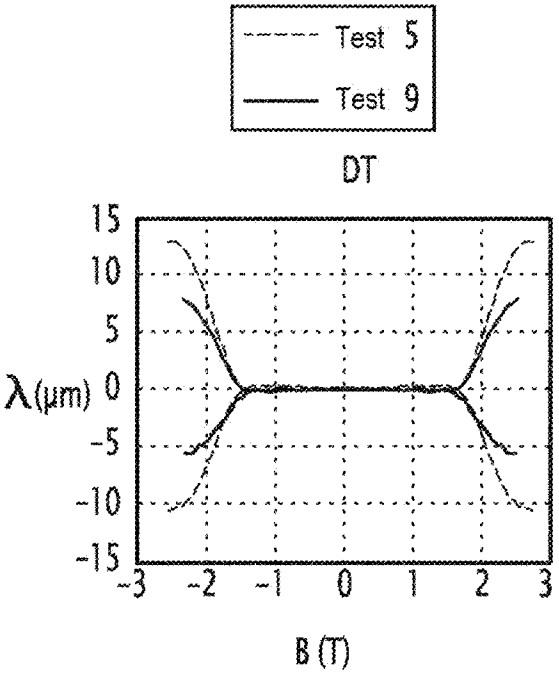

FIGS. 7 to 9 compare the magnetostrictive measurements recorded for tests 5 and 9 according to the invention. FIG. 7 shows the tests carried out according to the direction DT, while FIG. 8 shows the tests carried out in the direction 45°, and FIG. 9 shows the tests carried out according to the direction DT. The results are very comparable and excellent for the two tests according to the DL and DT directions up to inductions of ±1.8 T. In the case of the 45° direction, the magnetostriction begins to be not quite negligible from 1.8 T approximately in the case of the test 5, while in test 9 it remains very low even beyond 2 T. In general, a final annealing temperature of 900° C. thus gives results of magnetostriction better than a final annealing at 700° C. But already at 700° C., the magnetostriction at 1.8 T does not exceed ±5 ppm in the three directions of measurement, which is very significantly better than for the reference tests, both for the absolute value of the magnetostriction and for its isotropy.

The results of the test 9 are particularly remarkable at high inductions of 1.8 T or a little beyond, both with respect to the low value of the magnetostriction and its isotropy.

Figure 10:
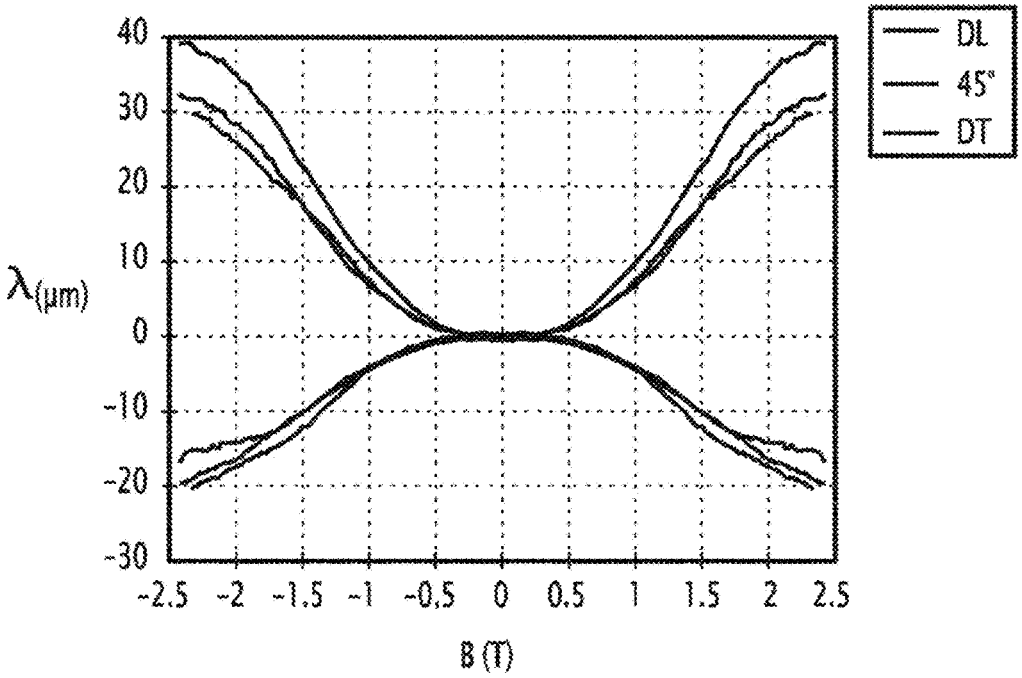

FIG. 10 shows the results of the reference test 10 wherein the final annealing was carried out at 1100° C., thus in the austenitic range, while the two previous annealings 1 and 2, carried out at 900° C. as were all the annealings 1 and 2 of the tests according to the invention, were carried out in the ferritic range. Magnetostriction curves are found in the various directions that are qualitatively and quantitatively comparable with those of the other reference tests 1 and 2, as seen in FIGS. 3 and 4. It may be concluded that the passage of the alloy in the austenitic range during one of its annealings, even if it occurs only at the end of the treatment, constitutes a very important factor in the failure to obtain a low and isotropic magnetostriction.

Figure 11:
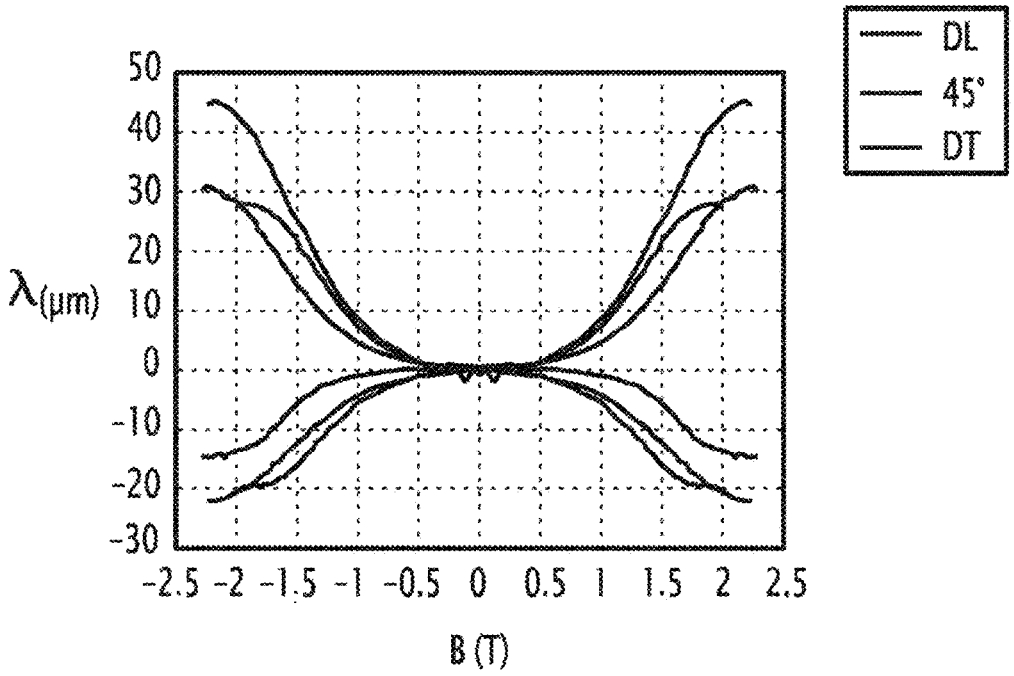

Test 11, in which the second cold rolling was carried out with a reduction rate of only 40%, shows, according to FIG. 11, a conventional parabolic and little isotropic magnetostriction behavior as a function of induction, therefore a behavior outside the invention, with for example a magnetostriction according to DL of more than 35 ppm at 1.5T, and nearly 60 ppm at 1.8T. It may be concluded that textural filiation, modulated by cold rolling reduction rates, is indeed controlled by texture transformations during cold rolling, which restricts the invention to certain reduction rate ranges.

Figure 12:
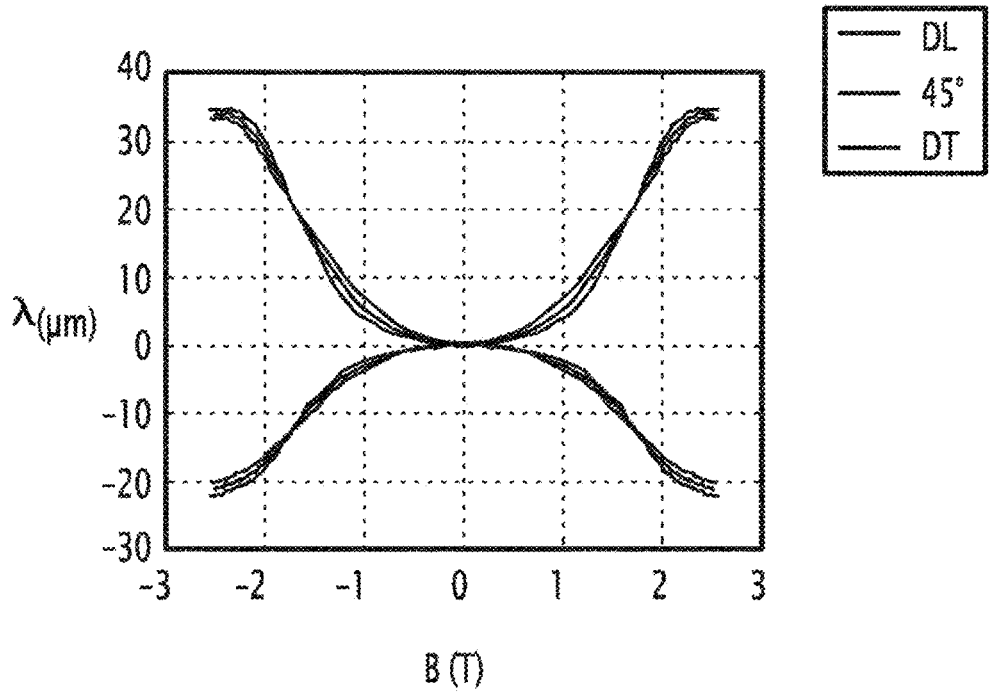

FIG. 12 shows the results of the reference test in which the intermediate annealing was carried out at 1100° C., thus in the austenitic range, while both annealings 1 and 3 were carried out at 900° C. as all annealings 1 and 3 of the tests according to the invention, and thus in the ferritic range. Magnetostriction curves in the various directions are found comparable to those of the other reference tests 1, 2 and 10, as seen in FIGS. 3, 4 and 10, with, however, a fairly significant isotropy of the magnetostriction. But the level of magnetostriction remains too high, even for relatively low inductions. It may be concluded, in conjunction with the test 10, that the passage of the alloy in the austenitic range during any of its annealings, is a very important factor in the failure to obtain a magnetostriction that is both low and isotropic It was also surprisingly found that the magnetic losses at 400 Hz for different inductions (1, 1.2 and 1.5 T) were significantly lower in the case of the materials obtained according to the invention than they were for reference materials with non-oriented grains. It would have been thought that the examples according to the invention could present unacceptable induced magnetic flux losses, either because of their not entirely recrystallized structure (tests 3 and 4), or because of their fine grain microstructures. However, the results presented in Table 4 demonstrate the opposite. They were obtained on samples 0.2 mm thick, 100 mm long and 20 mm wide, cut along DL, immersed in a 400 Hz fundamental frequency magnetic field and by forming the magnetic induction into a temporally sinusoidal shape. The measurements were made for maximum amplitudes of induction B of intensity equal to 1, 1.2, 1.5 or 1.8 T. The magnetic losses are expressed in W/kg.

TABLE 4

| Magnetic losses at 400 Hz measured on different samples | | | | | |
|---|---|---|---|---|---|
| | Composition/final annealing | B = 1 T | B = 1.2 T | B = 1.5 T | B = 1.8 T |
| Test 1 (reference) | A/900° C. | 40 | 50 | 78 | 113 |
| Test 2 (reference) | A/700° C. | 47 | 61 | 120 | 156 |
| Test 3 (invention) | B/660° C. | 48 | 62 | 90 | 130 |
| Test 5 (invention) | B/700° C. | 48 | 62 | 90 | 113 |
| Test 7 (invention) | B/750° C. | 32 | 44 | 65 | 96 |
| Test 8 (invention) | B/810° C. | 27 | 38 | 56 | 80 |
| Test 9 (invention) | B/900° C. | 22 | 30 | 45 | 63 |
| Test 10 (reference) | B/1100° C. | 35 | 48 | 75 | 101 |

As may be seen, the magnetic losses of the samples produced according to the invention and having reduced size grains and a structure not completely recrystallized (tests 3 and 4) or completely recrystallized thanks to a final annealing at 700° C. or more, are not particularly high, and remain competitive with that obtained on the reference samples. Above all, the samples according to the invention which are 100% recrystallized and produced with a final annealing at 720° C. and more (up to 810° C., test 8 or better 900° C. test 9) have magnetic losses that are still significantly better compared with the reference samples, including test 1, which has a high grain size and a 100% recrystallized structure. This advantage with respect to magnetic losses is, for the moment, not clearly explained by the inventors. It is all the more remarkable when one operates at inductions higher than 1.5 T, like 1.8 T (see Table 4), since the magnetic losses vary according to the square of the induction. This is, again, an advantage for use in aircraft on-board transformers, the dimensioning of which is strongly related to the elimination of the various losses (by Joule and magnetic effects).

It should be noted that surprisingly, while the large grain size of the reference test 10 was a priori in the direction of obtaining the lowest magnetic losses, it is test 9 according to the invention that has the lowest magnetic losses.

In general, the results are all the more favorable in terms of magnetic losses as the final ferritic annealing temperature is higher, wherein the best results are obtained for the sample of test 9 which was annealed at 900° C.

For the magnetostriction, the ferritic annealing temperatures between 800 and 900° C. show a weakly to very weakly marked deformation anisotropy and magnetostriction Max $\Delta\lambda$ amplitudes not exceeding, in any case, 6 ppm at 1.5T, 15 ppm at 1.8T, therefore significantly better than those of the reference test samples.

In general, the invention is defined by saying, in particular, that all the annealings must take place in the ferritic range, at a minimum temperature of 650° C. and at a maximum temperature which, taking into account the effective composition of the alloy, is well in the purely ferritic range, without a transformation of at least a portion of the ferrite into austenite taking place. We have seen above what this maximum temperature was as a function of the Si, Co and C contents of the alloy.

The strips obtained according to the invention may be used to form transformer cores which are both of the "stamp and stack" type and "rolled-up" type transformer as defined above. In the latter case, to achieve the winding, it is necessary to use very thin strips of the order of 0.1 to 0.05 mm thick, for example.

As has been said, an annealing performed before the first cold rolling is preferably carried out within the scope of the invention. However, this annealing is not essential, especially in the case where the hot-rolled strip has been in the wound state for a long time during its natural cooling. In this case, the winding temperature is often of the order of 850-900° C., wherein the duration of this stay may be quite sufficient to obtain on the microstructure of the strip at this stage very comparable effects to those that would be provided by a real annealing in the ferritic range performed under the conditions that have been given for the optional annealing before the first cold rolling.

Table 5 recalls the results obtained in the previously described tests 1 and 9 on the isotropy of magnetostriction and the magnetic losses at 1.5 T, 400 Hz, and adds information on the suitability for cold or warm rolling of the samples before they are subject to a treatment according to the method of the invention, and saturation magnetization Js of the final product. These results are also compared with those obtained in tests 13 to 24, in which alloys of compositions conforming to the invention (13 to 19 and 23, 24) or not (20 to 22) were also tested. The compositions of these new alloys are also specified, with those of tests 1 and 9 as a reminder. Samples K and L of tests 21 and 22 having proved unfit for cold or warm rolling (breakage due to brittleness, starting from the middle of the strip towards the edges), these tests were not continued beyond the rolling attempt, hence the lack of results for them in Table 5.

For all these samples, the final thickness is 0.2 mm.

TABLE 5

| Test Conditions and Results 1, 9, 13-24 | | | | | | | | |
|---|---|---|---|---|---|---|---|---|
| | Alloy A (%) Ref. | Alloy B (%) Inv. | Alloy C (%) Inv. | Alloy D (%) Inv. | Alloy E (%) Inv. | Alloy F (%) Inv. | Alloy G (%) Inv. | Alloy H (%) Inv. |
| Test | 1 | 9 | 13 | 14 | 15 | 16 | 17 | 18 |
| C | 0.010 | 0.009 | 0.007 | 0.023 | 0.012 | 0.013 | 0.011 | 0.012 |
| Mn | 0.261 | 0.256 | 0.195 | 0.234 | 0.248 | 0.421 | 0.532 | 0.810 |
| Si | 0.142 | 0.153 | 0.330 | 0.720 | 0.031 | 2.73 | 0.070 | 0.013 |
| S | 0.0023 | 0.0042 | 0.0033 | 0.0021 | 0.0048 | 0.0008 | 0.0006 | 0.0028 |

TABLE 5-continued

Test Conditions and Results 1, 9, 13-24

| | | | | | | | | |
|---|---|---|---|---|---|---|---|---|
| P | 0.0025 | 0.0055 | 0.0031 | 0.0029 | 0.0029 | 0.0032 | 0.0047 | 0.0037 |
| Ni | 0.030 | 0.030 | 0.100 | <0.01 | 0.130 | <0.01 | <0.01 | <0.01 |
| Cr | 0.514 | 0.498 | 1.00 | 0.200 | 0.011 | 0.008 | 0.048 | 6.06 |
| Mo | <0.005 | <0.005 | <0.005 | <0.005 | <0.005 | <0.005 | <0.005 | 0.17 |
| Cu | 0.009 | 0.010 | <0.005 | <0.005 | <0.005 | <0.005 | <0.005 | <0.005 |
| Co | 27.09 | 27.32 | 18.35 | 10.07 | 4.21 | 0.02 | <0.01 | 27.11 |
| V | 0.01 | 0.01 | <0.005 | 0.51 | <0.005 | <0.005 | <0.005 | <0.005 |
| Al | <0.001 | <0.001 | 0.14 | <0.001 | <0.001 | 0.60 | <0.001 | <0.001 |
| Nb | <0.001 | <0.001 | <0.001 | <0.001 | 0.005 | <0.001 | <0.001 | <0.001 |
| Ti | <0.001 | <0.001 | <0.001 | 0.08 | <0.001 | <0.001 | <0.001 | <0.001 |
| N | 0.0015 | 0.0044 | 0.0023 | 0.0036 | 0.0043 | 0.0027 | 0.0041 | 0.0045 |
| Ca | <0.0003 | <0.0003 | <0.0003 | 0.0013 | <0.0003 | <0.0003 | 0.0009 | <0.0003 |
| Mg | <0.0002 | <0.0002 | 0.0006 | <0.0002 | <0.0002 | 0.0005 | 0.0004 | <0.0002 |
| Ta | <0.002 | <0.002 | 0.0025 | <0.002 | <0.002 | <0.002 | <0.002 | <0.002 |
| B | <0.0005 | <0.0005 | <0.0005 | <0.0005 | <0.0005 | <0.0005 | <0.0005 | 0.0007 |
| W | <0.005 | <0.005 | <0.005 | <0.005 | 0.28 | <0.005 | <0.005 | <0.005 |
| Fe | 71.93 | 71.7 | 79.87 | 88.15 | 95.06 | 96.20 | 99.33 | 65.81 |
| Suitable for cold or warm rolling | YES | YES | YES | YES | YES | YES | YES | YES |
| Final annealing temperature R3 (° C.) | 900 | 900 | 900 | 900 | 850 | 850 | 850 | 900 |
| Final annealing duration R3 (min) | 60 | 60 | 600 | 600 | 300 | 120 | 120 | 300 |
| Max Δλ à 1.2 T (ppm) | 31 | 1.5 | 2 | 5 | 6 | 5 | 10 | 2.5 |
| Max Δλ à 1.5 T (ppm) | 44 | 3 | 6 | 8 | 9 | 8 | 13 | 4 |
| Max Δλ à 1.8 T (ppm) | 66.5 | 5 | 8 | 11 | 13 | 12 | 18 | 7.5 |
| Magnetic losses 1.5 T/400 Hz (W/kg) | 78 | 45 | 49 | 52 | 53 | 38 | 59 | 38 |
| Js (T) | 2.35 | 2.35 | 2.25 | 2.20 | 2.16 | 1.97 | 2.14 | 2.12 |

| | Alloy I (%) Inv. | Alloy J (%) Ref. | Alloy K (%) Ref. | Alloy L (%) Ref. | Alloy M (%) Inv. | Alloy N (%) Inv. |
|---|---|---|---|---|---|---|
| Test | 19 | 20 | 21 | 22 | 23 | 24 |
| C | 0.010 | 0.008 | 0.009 | 0.009 | 0.012 | 0.015 |
| Mn | 0.167 | 0.208 | 0.520 | 0.289 | 0.368 | <0.010 |
| Si | 3.50 | 0.023 | 3.07 | 1.53 | 0.640 | 0.083 |
| S | 0.0005 | 0.0015 | 0.0007 | 0.0044 | 0.0008 | <0.0005 |
| P | 0.0053 | 0.0031 | 0.0043 | 0.0049 | 0.0041 | <0.0005 |
| Ni | <0.01 | <0.01 | <0.01 | <0.01 | 0.080 | <0.01 |
| Cr | 0.047 | 0.089 | 0.007 | 0.038 | 0.072 | <0.01 |
| Mo | <0.005 | <0.005 | <0.005 | <0.005 | <0.005 | <0.005 |
| Cu | <0.005 | <0.005 | <0.005 | <0.005 | <0.005 | <0.005 |
| Co | <0.01 | 49.00 | 18.20 | 38.15 | 38.82 | 15.10 |
| V | <0.005 | 2.03 | <0.005 | <0.005 | <0.005 | <0.005 |
| Al | <0.001 | <0.001 | <0.001 | <0.001 | <0.001 | <0.001 |
| Nb | <0.001 | 0.040 | <0.001 | <0.001 | <0.001 | <0.001 |
| Ti | <0.001 | <0.001 | <0.001 | <0.001 | <0.001 | <0.001 |
| N | 0.0048 | 0.0018 | 0.0021 | 0.0019 | 0.0027 | 0.0012 |
| Ca | <0.0003 | 0.0007 | 0.0015 | <0.0003 | 0.0009 | <0.0003 |
| Mg | <0.0002 | 0.0004 | <0.0002 | 0.0004 | <0.0004 | <0.0002 |
| Ta | <0.002 | <0.002 | <0.002 | <0.002 | <0.002 | <0.002 |
| B | <0.0005 | <0.0005 | <0.0005 | <0.0005 | <0.0005 | <0.0005 |
| W | <0.005 | <0.005 | <0.005 | <0.005 | <0.010 | <0.010 |
| Fe | 96.75 | 48.59 | 78.19 | 59.97 | 60.00 | 84.80 |
| Suitable for cold or warm rolling | YES | YES | NO | NO | YES | YES |
| Final annealing temperature R3 (° C.) | 850 | 880 | | | 900 | 900 |
| Final annealing duration R3 (min) | 30 | 180 | | | 60 | 60 |
| Max Δλ à 1.2 T (ppm) | 4 | 28 | | | 9 | 2.7 |
| Max Δλ à 1.5 T (ppm) | 7 | 46 | | | 15 | 3.5 |
| Max Δλ à 1.8 T (ppm) | 10 | 73 | | | 23 | 5 |

TABLE 5-continued

| Test Conditions and Results 1, 9, 13-24 | | | | |
|---|---|---|---|---|
| Magnetic losses 1.5 T/400 Hz (W/kg) | 36 | 42 | 48 | 51 |
| Js (T) | 2.02 | 2.35 | 2.34 | 2.25 |

As we have seen, the sample A (test 1) underwent, without prior annealing, an LAF 1 at a reduction rate of 84%, then a continuous annealing R1 at 1100° C. for 3 min, then an LAF 2 at a reduction rate of 50%, then a static annealing R2 at 900° C. for 1 h.

The samples B to H (tests 2 to 18) underwent a continuous annealing R1 at 900° C. for 8 min, then an LAF 1 at a 70% reduction rate, followed by an annealing R2 at 900° C. for 8 min at 900° C., then an LAF 2 at 70% reduction rate, then a static annealing R3 at different temperatures and times, as noted in Table 5.

Sample I (test 19) underwent an annealing R1 at 900° C. for 8 min, followed by warm rolling 1 at 150° C. at a 70% reduction rate, followed by an annealing R2 at 900° C. for 8 min, then a warm rolling 2 at 150° C. with a reduction rate of 70% and a static annealing R3 at 850° C. for 30 min.

Sample J (test 20) underwent a static annealing R1 at 935° C. for 1 h, then an LAF 1 at 70% reduction rate, followed by an R2 annealing at 900° C. for 8 min, followed by an LAF 2 at 70% reduction rate, then an R3 static annealing at 880° C. for 1 h.

As we have seen, the reference test 1 carried out on the FeCo27 alloy A did not give satisfactory results, from the point of view of the isotropy of the magnetostriction: see the high values of Max $\delta\lambda$ observed. This is apparently related to the fact that one of its annealings (R1) was carried out at a high temperature (1100° C.) located in the austenitic range.

The test 9 according to the invention, carried out on the alloy B which is also an FeCo27, and for which all the annealings took place in the ferritic range, led, on the other hand, to an excellent isotropy of the magnetostriction.

This good isotropy of the magnetostriction is found in tests 13 and 14, which concern FeCo alloys with Co contents lower than 27%: respectively about 18 and 10%, and whose composition and treatments are, moreover, in accordance with the other requirements of the invention. Example 13 also shows relatively significant levels of Si, Cr, Al, Ca, Ta. Example 14 also shows significant Si, V and Ti contents. But all these contents remain within the limits defined for the invention.

Similarly, a good isotropy of the magnetostriction is present in the test 23 which concerns an FeCo alloy having a Co content of nearly 39%, thus substantially higher than 27% but remaining within the limit of 40% as the maximum set for the invention, and a Si content which is significant, but is not so high as to compromise the suitability for cold or warm rolling.

The magnetic losses and the saturation magnetization are of the same order of magnitude as for the other samples treated according to the invention.

Regarding the test 24, it relates to a 15% Co alloy and that is free of significant levels of other alloying elements, including Cr. It also has a particularly low and isotropic magnetostriction. The magnetic losses and the saturation magnetization are of the same order of magnitude as for the other samples treated according to the invention. In particular, compared to the test 13, the absence of Cr in the test 24, wherein this absence tends to increase the saturation magnetization, is compensated by a slightly lower content of Co which trends towards a decrease in saturation magnetization. Similarly, the absence of Cr in test 24 trends towards an increase of the magnetic losses compared to the test 13, while the lower content of Co in the test 24 trends towards a decrease of these same magnetic losses. Thus, the differences in the composition of the alloy between the tests 13 and 24 tend to offset each other from the point of view of the magnetic losses and of Js.

As regards the reference test 20, it was carried out on an FeCo alloy at 49% Co, thus above the upper limit of 40% allowed by the invention. All its annealings were carried out in the ferritic range. Its magnetic losses are very acceptable, but its magnetostriction does not present the desired isotropy. As has been said, at these too high levels of Co, the order-disorder transition during heat treatments is most probably too fast and too acute, and the number of annealings required by the invention is not compatible with this composition of the alloy. The presence of 0.04% Nb, although still below the maximum limit tolerated by the invention, may have also contributed to hinder the texture filiation mechanism, which has been said to be an explanation for the isotropy of the magnetostriction observed when applying the method according to the invention.

As regards reference test 21, its Si content is too high in relation to the Co content, while the condition "Si(wt %)+0.6Al(wt %)≤4.5(wt %)−0.1Co(wt %) if Co<35%" required by the invention is not satisfied. The consequence is, as explained above, that the alloy is not suitable for cold or warm rolling, as experience confirms.

As regards the reference test 22, it is a case where Co is ≥35% and where Si, according to the invention, should not exceed 1% in order to ensure good cold rolling or warm rolling ability. However, the Si content in this test is 1.53%: again it is confirmed that good cold or warm rollability of the alloy is obtained only under certain compositional conditions, which must be integrated into the definition of the invention.

The test 15 according to the invention shows that a relatively low Co content (4.21%) is not contradictory to obtaining the desired good magnetostriction isotropy, if the contents of Si and Al are sufficiently low. The presence of 0.005% of Nb does not hinder the achievement of the desired results.

The test 16 according to the invention relates to an Fe—Si—Al alloy with a very low content of C. In this case, the desired isotropic magnetostriction is also obtained, together with low magnetic losses.

The test 17 according to the invention relates to an alloy which is practically 99% pure Fe, with relatively low Mn, Ca, Mg contents. The isotropy of the magnetostriction is less than in the other tests according to the invention, but it is nevertheless very good in absolute terms, since Max $\Delta\lambda$ at 1.8 T remains ≤25 ppm as required on the sheets or strips according to the invention. The magnetic losses are also a little higher than for the other tests according to the invention, but remain at a good level, and are lower than those found on the reference test 1.

Test 18 according to the invention relates to a FeCo27 alloy with a high Cr content (6%) and also containing Mn (0.81%) and some Mo and B. The good isotropy of the magnetostriction is confirmed, and the magnetic losses are as low as for the test 16 despite the presence of 7 ppm of B. The saturation magnetization remains of the order of that observed during the other tests, since the contents of Cr, Mn and Mo are not high enough to deteriorate it undesirably.

Test 19 according to the invention relates to an Fe—Si alloy containing 3.5% Si and not containing Al, and shows that the operating conditions of the process according to the invention are also applicable with advantage to this type of FeSi3 alloy in order to obtain the desired magnetostrictive isotropy. In addition, this example has particularly low magnetic losses.

Table 6 presents experimental results obtained by varying the treatment conditions, the composition of the treated alloy, and the final thickness of the sample. The results of the previous Tests 1 and 9 were repeated, and new tests 25 to 31 carried out on alloys having the compositions B (FeCo27), I (FeSi3) and C (FeCo18) as explained in Table 5.

TABLE 6

Influence of the treatment conditions on isotropy of the magnetostriction for different alloy compositions and final thicknesses of the sample

| Test No. | Alloy | Final thickness (mm) | Annealing duration R1 (min) | Reduction rate LAF 1 (%) | Annealing duration R2 (min) | Reduction rate LAF 2 (%) | Annealing temperature R3 (° C.) | Duration R3 (min) | Max Δλ at 1.8 T (ppm) | |
|---|---|---|---|---|---|---|---|---|---|---|
| 1 | A | 0.2 | 0 | 84 | 3 | 50 | 900 | 60 | 66.5 | Reference |
| 9 | B | 0.2 | 8 | 70 | 8 | 70 | 900 | 60 | 6 | Invention |
| 25 | B | 0.2 | 8 | 70 | 8 | 70 | 900 | 240 | 7 | Invention |
| 26 | B | 0.2 | 8 | 70 | 8 | 70 | 900 | 1440 | 5 | Invention |
| 27 | B | 0.2 | 8 | 70 | 8 | 70 | 920 | 60 | 2.7 | Invention |
| 28 | B | 0.2 | 8 | 70 | 8 | 70 | 920 | 240 | 5.4 | Invention |
| 29 | B | 0.2 | 8 | 70 | 8 | 70 | 920 | 1440 | 6 | Invention |
| 30 | I | 0.2 | 60 | 70 | 60 | 70 | 850 | 180 | 16 | Invention |
| 31 | C | 0.5 | 5 | 60 | 5 | 50 | 900 | 60 | 18.5 | Invention |

If we compare the results of the different tests according to the invention as carried out on samples of the same composition, we see that varying the LAF parameters and annealing within the limits of the definition of the invention still allows an isotropy of magnetostriction to be obtained that is unusually good in all cases.

It may be noted that concerning the alloy I (of the FeSi3 type), a comparison between the tests 19 and 30 makes it possible to deduce that the increase in the temperature and the duration of the final annealing R3 in the test 30 caused some degradation of this isotropy, which remains, in spite of all, within the limits of the objectives fixed. This degradation is believed to be related to the fact that the Goss texture component was probably stronger in the test and close to the preferred upper limit of 30%, as well as due to differences in the hot rolling process.

It may also be noted that, with regard to the alloy C (FeCo18 type), a final thickness of 0.5 mm obtained before the final R3 annealing leads, under identical final annealing R3 conditions, to a certain degradation of the isotropy of the magnetostriction (see test 31). It could be remedied by increasing, for this thickness, the duration and/or the temperature of the final annealing while remaining within the limits fixed by the definition of the invention.

In general, it may be seen from the various tests carried out, that the magnetic properties of the samples (magnetic losses and magnetostriction in particular) are relatively little dependent on the precise conditions of the final annealing, contrary to what has often been seen in the prior art. The use of multiple rolling with an intermediate annealing between each rolling, and a final annealing after the last cold rolling (and not a single cold rolling followed by a final annealing), combined with obtaining a final product that is very strongly, if not totally, recrystallized, could be one of the factors conducive to this wide tolerance in the conditions of manufacture, which is obviously very advantageous. The persistence, over the course of manufacture, of at least a small proportion of Goss textures and {111}<110> textures (or, in general, less than 30% of any texture component {hkl}<uvw> defined by a disorientation of less than 15° from a defined crystallographic orientation $\{h_0k_0l_0\}<u_0v_0w_0>$), which the method according to the invention makes it possible to obtain, could also contribute to this result. The inventors are, however, for the moment only at the hypothesis stage in explaining the remarkable properties obtained both with respect to the isotropy of the magnetostriction and the magnetic characteristics resulting from the application of the process of the invention.

The strips and sheets according to the invention make it possible to manufacture, in particular, after cutting, transformer cores composed of stacked or wound sheets, without requiring modifications of the general design of the cores of these types usually used. It is thus possible to take advantage of the properties of these sheets to produce transformers producing only low magnetostriction noise compared to existing transformers of similar design and dimensioning. Transformers for aircraft intended to be installed in a cockpit are a typical application of the invention. These sheets may also be used to form cores of transformers of higher mass, thus intended for transformers of particularly high power, while maintaining a magnetostriction noise that remains within acceptable limits. Transformer cores according to the invention may consist entirely of sheets made from strips or sheets according to the invention, or only partially in cases where it would be considered that their combination with other materials would be technically or financially advantageous.

What is claimed is:

1. Sheet or strip of cold rolled and annealed ferrous alloy, wherein its composition consists of, in weight percentages:

$0<C\leq 0.2\%$;

$0<Co\leq 40\%$;

if $Co\geq 35\%$, $0<Si\leq 1.0\%$;

if $0<Co<35\%$, $0<Si\leq 3.5\%$;

if $0<Co<35\%$, $Si(wt\ \%)+0.6\cdot Al(wt\ \%)\leq 4.5(wt\ \%)-0.1\cdot Co(wt\ \%)$;

$0<Cr\leq 10\%$;

$0<V+W+Mo+Ni\leq 4\%$;

$0<Mn\leq 4\%$;

$0<Al\leq 3\%$;

$0<S\leq 0.005\%$;

$0<P\leq 0.007\%$;

$0<Ni\leq 3\%$;

$0<Cu\leq 0.5\%$;

$0<Nb\leq 0.01\%$;

$0<Zr\leq 0.1\%$;

$0<Ti\leq 0.2\%$;

$0<N\leq 0.01\%$;

$0<Ca\leq 0.01\%$;

$0<Mg\leq 0.01\%$;

$0<Ta\leq 0.01\%$;

$0<B\leq 0.005\%$;

$0<O\leq 0.01\%$;

the remainder being iron and impurities resulting from the preparation, wherein, for an induction of 1.8 T, the magnetic losses at 400 Hz are of at most 130 W/kg, and the maximum difference (Max $\Delta\lambda$) between the magnetostriction deformation amplitudes $\lambda$, measured parallel to the magnetic field (Ha) applied ($\lambda//H$) and perpendicular to the magnetic field (Ha) applied ($\lambda^{\perp}H$) on three rectangular samples of the said sheet or strip, whose long sides are respectively parallel to the direction of rolling (DL) of the said sheet or strip, parallel to the transverse direction (DT) of the said sheet or strip, and parallel to the direction forming an angle of 45° with the said rolling direction (DL), and with the said transverse direction (DT), is at most 25 ppm, and in that its recrystallization rate is 80 to 100%, and wherein each texture component $\{h_0k_0l_0\}<u_0v_0w_0>$ of the material is not more than 30% by volume of the volumetric fraction of the grains of the material, said texture component being defined by all the grains showing a crystallographic orientation {hkl } [uvw] having an angular disorientation of less than 15° from the specific {h0k0l0}<u0v0w0> orientation that defines said texture component.

2. Sheet or strip according to claim 1, wherein $10\%\leq Co\leq 35\%$.

3. Sheet or strip according to claim 1, wherein $0<C\leq 0.05\%$.

4. Sheet or strip according to claim 3, wherein $0<C\leq 0.015\%$.

5. Sheet or strip according to claim 1, wherein, if $0<Co<35\%$, $Si(wt\ \%)+0.6\cdot Al(wt\ \%)\leq 3.5(wt\ \%)-0.1\cdot Co(wt\ \%)$.

6. Sheet or strip according to claim 1, wherein $0<V+W+Mo+Ni\leq 2\%$.

7. Sheet or strip according to claim 1, wherein $0<Mn\leq 2\%$.

8. Sheet or strip according to claim 1, wherein $0<Al\leq 1\%$.

9. Sheet or strip according to claim 1, wherein $0<Ni\leq 0.3\%$.

10. Sheet or strip according to claim 1, wherein $0<Cu\leq 0.05\%$.

11. Sheet or strip according to claim 1, wherein $0<Zr\leq 0.01\%$.

12. A transformer magnetic core, comprising stacked or rolled-up sheets, wherein at least some of the sheets are a sheet or strip according to claim 1.

* * * * *